US006371734B1

(12) United States Patent
Ota et al.

(10) Patent No.: US 6,371,734 B1
(45) Date of Patent: Apr. 16, 2002

(54) CONTROL VALVE FOR VARIABLE DISPLACEMENT COMPRESSOR

(75) Inventors: Masaki Ota; Masahiro Kawaguchi; Masanori Sonobe; Tomoji Tarutani; Ken Suitou; Ryo Matsubara; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/657,124

(22) Filed: Sep. 7, 2000

(30) Foreign Application Priority Data

Sep. 10, 1999 (JP) ..... 11-257794

(51) Int. Cl.[7] ..... F07B 1/26
(52) U.S. Cl. ..... 417/222.2; 92/12.2
(58) Field of Search ..... 417/222.2, 310, 417/295; 92/12.2; 62/133, 196.3

(56) References Cited

U.S. PATENT DOCUMENTS 4,846,630 A * 7/1989 Fujii et al. ..... 417/222.2
4,850,810 A * 7/1989 Higuchi et al. ..... 417/222.2
4,940,395 A * 7/1990 Yamamoto et al. ..... 417/310
6,164,925 A * 12/2000 Yocomachi et al. ..... 417/222.2
6,174,140 B1 * 1/2001 Ota et al. ..... 417/222.2
6,217,292 B1 * 4/2001 Ota et al. ..... 417/222.2
6,244,159 B1 * 6/2001 Kimura et al. ..... 92/12.2

* cited by examiner

*Primary Examiner*—Mark Paschall
*Assistant Examiner*—Leonid M Fastovsky
(74) *Attorney, Agent, or Firm*—Morgan & Finnegan, LLP

(57) ABSTRACT

A control valve used for a variable displacement compressor comprises a valve housing, a valve chamber defined in the valve housing, a valve body. The valve body is located in the valve chamber. A pressure sensing chamber is defined in the valve housing. A movable wall is located in the sensing chamber to divide a first pressure chamber and a second pressure chamber. The movable wall moves in accordance with the pressure difference between the first pressure chamber and the second pressure chamber. A rod transmits the movement of the movable wall to the valve body. The pressure directed in the vicinity of the end portion of the rod is the same type pressure directed in the first pressure chamber or in the second pressure chamber. An actuator determines the target pressure difference between the two pressure chambers. This permits the displacement of the compressor to be quickly changed.

25 Claims, 14 Drawing Sheets

CONTROL VALVE FOR VARIABLE DISPLACEMENT COMPRESSOR

BACKGROUND OF THE INVENTION

The present invention relates to a control valve for variable displacement compressors to control displacement.

A refrigeration circuit of a typical vehicle air-conditioning system includes a condenser, an expansion valve, which functions as a depressurizing device, an evaporator and a compressor. The compressor draws refrigerant gas from the evaporator and compresses the gas. The compressor then discharges the gas to the condenser. The evaporator performs heat exchange between the refrigerant in the circuit and air in the passenger compartment. Heat from air that flows about the evaporator is transferred to the refrigerant flowing through the evaporator in accordance with the thermal load or the cooling load. The pressure of the refrigerant gas at the outlet of the evaporator represents the magnitude of the thermal load.

A vehicle variable displacement swash plate type compressor has a displacement control mechanism for setting the pressure (suction pressure Ps) in the vicinity of the outlet of the evaporator to a predetermined target suction pressure. The mechanism adjusts the compressor displacement by changing the inclination angle of the swash plate such that the flow rate of refrigerant corresponds to the cooling load. To control the displacement, a control valve is used. The control valve includes a pressure sensing member, which is a bellows or a diaphragm. The pressure sensing member detects the suction pressure Ps. A valve opening is adjusted in accordance with the displacement of the pressure sensing member, which changes the pressure in a crank chamber, or crank pressure Pc.

A simple control valve that imposes a single target suction pressure cannot control the air conditioning performance accurately. Therefore, an electromagnetic control valve that changes a target suction pressure in accordance with an external current has been introduced. Such a control valve includes an electromagnetic actuator such as a solenoid. The actuator changes a force acting on a pressure sensing member in accordance with an external current to adjust the target suction pressure.

A typical vehicle compressor is driven by an engine. The compressor consumes a significant amount of the power (or the torque) of the engine. Therefore, when the load on the engine is great, for example, when the vehicle is accelerating or moving uphill, the compressor displacement is minimized to reduce the engine load. Specifically, the value of current supplied to the electromagnetic control valve is controlled for setting the target suction pressure to a relatively great value. Accordingly, to increase the actual suction pressure toward the target suction pressure, the control valve operates such that the compressor displacement is minimized.

A graph of FIG. 14 illustrates the relationship between a suction pressure Ps and the displacement Vc of a compressor. The relationship is represented by multiple lines in accordance with the thermal load in an evaporator. Thus, if a level Ps1 is set as a target suction pressure Pset, the actual displacement Vc varies in a certain range (ΔVc in FIG. 14) due to the thermal load. For example, when an excessive thermal load is applied to the evaporator, an increase of the target suction pressure Pset may not decrease the engine load. That is, even if the target suction pressure Pset is raised, the compressor displacement Vc will not be lowered to a level that reduces the engine load unless the thermal load on the evaporator is relatively small.

The suction pressure Ps represents the thermal load on an evaporator. The method for controlling the displacement of a variable displacement compressor based on the suction pressure Ps is appropriate for maintaining the temperature in a vehicle compartment at a comfortable level. However, to quickly decrease the displacement, displacement control that is based only on the suction pressure Ps is not always appropriate. For example, displacement control based on the suction pressure Ps is not suitable for the above described displacement limiting control procedure, in which the displacement must be quickly decreased to make the engine power available for acceleration.

SUMMARY OF THE INVENTION

Accordingly, it is an objective of the present invention to provide a control valve that quickly and reliably changes the displacement of a compressor regardless of the state of the thermal load on an evaporator.

To achieve the above objective, the present invention provides a control valve used for a variable displacement compressor in a refrigerant circuit. The compressor includes a crank chamber, a discharge pressure zone, a suction pressure zone, a supply passage for connecting the discharge pressure zone to the crank chamber, and a bleed passage for connecting the suction pressure zone to the crank chamber. The control valve comprises a valve housing, a valve chamber defined in the valve housing. A movable valve body is located in the valve chamber to adjust opening size of the supply passage or the bleed passage. A pressure sensing chamber is defined in the valve housing. A dividing member is located in the sensing chamber to divide the pressure sensing chamber into a first pressure chamber and a second pressure chamber. The pressure at a first pressure monitoring point located in the refrigerant circuit is applied to the first pressure chamber. The pressure at a second pressure monitoring point located in the refrigerant circuit is applied to the second pressure chamber. The dividing member moves in accordance with the pressure difference between the first pressure chamber and the second pressure chamber. A rod has a proximal end and an distal end. The distal end is coupled to the dividing member and transmits the movement of the dividing member to the valve body. The pressure of the crank chamber is changed in accordance with the movement of the dividing member and the valve body to control the displacement of the compressor. The pressure in the vicinity of the distal end of the rod is exposed to the presence of the first pressure chamber or the second pressure chamber. An urging mechanism urges the rod axially with a force that represents a target pressure difference between the two pressure monitoring points.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A vehicle air-conditioning system according to a first embodiment of the present invention will now be described with reference to FIGS. 1 to 5.

Figure 1:
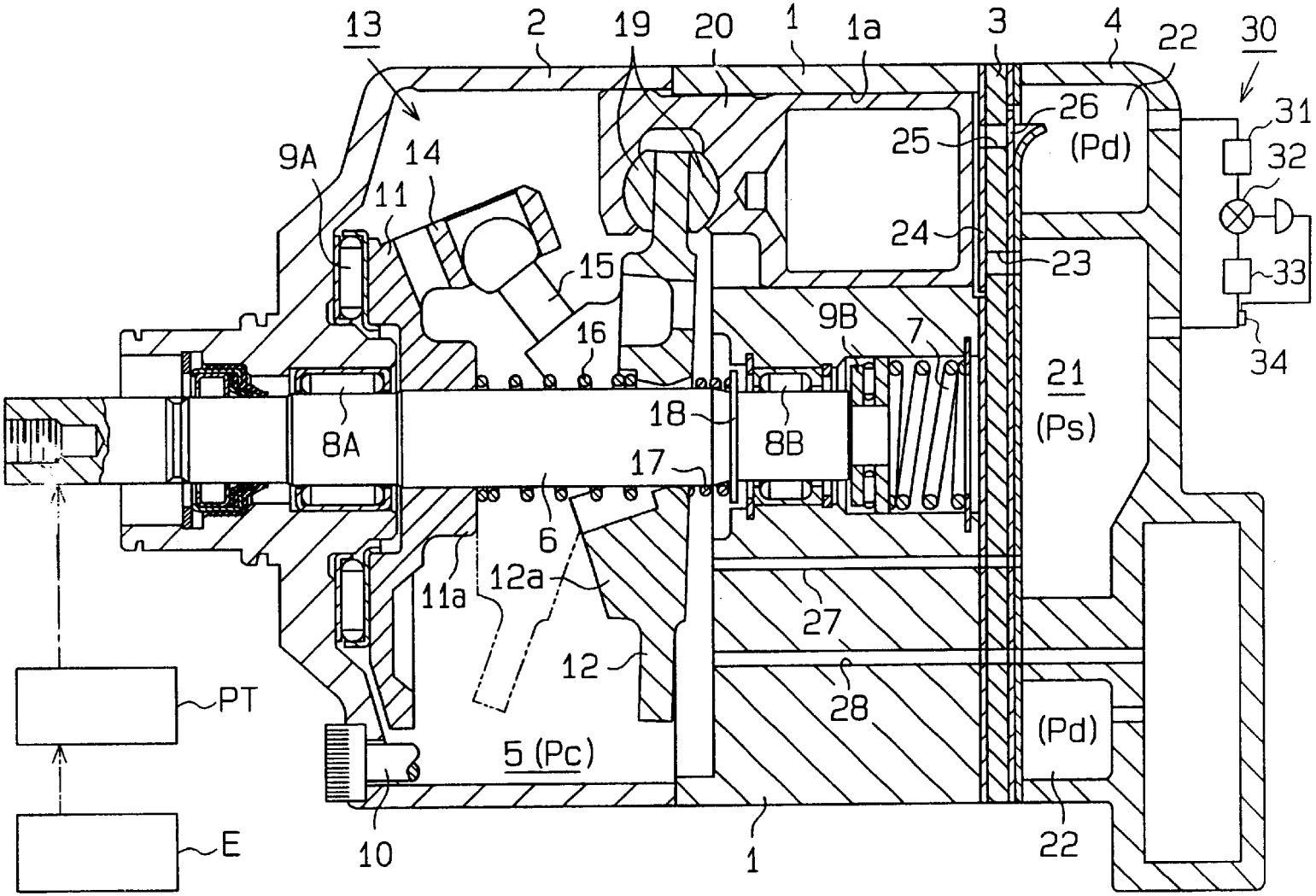
FIG. 1 is a cross-sectional view showing a swash plate type variable displacement compressor of a first embodiment according to the present invention.

The compressor shown in FIG. 1 is a swash plate type variable displacement reciprocal compressor. The compressor includes a cylinder block 1, a front housing member 2, which is secured to the front end face of the cylinder block 1, and a rear housing member 4, which is secured to the rear end face of the cylinder block 1. A valve plate 3 is located between the cylinder block 1 and the rear housing member 4. The cylinder block 1, the front housing member 2, the valve plate 3 and the rear housing member 4 are secured to one another by bolts 10 (only one is shown) to form the compressor housing.

A crank chamber 5 is defined between the cylinder block 1 and the front housing member 2. A drive shaft 6 extends through the crank chamber 5 and is rotatably supported through radial bearings 8A, 8B by the housing. A recess is formed in the center of the cylinder block 1. A spring 7 and a rear thrust bearing 9B are located in the recess. A lug plate 11 is secured to the drive shaft 6 in the crank chamber 5 to rotate integrally with the drive shaft 6. A front thrust bearing 9A is located between the lug plate 11 and the inner wall of the front housing member 2. A rear thrust bearing 9B is located adjacent to the rear end of the drive shaft 6. The drive shaft 6 is supported in the axial direction by the rear bearing 9B, which is urged forward by the spring 7, and the front bearing 9A.

The front end of the drive shaft 6 is connected to an external drive source, which is an engine E in this embodiment, through a power transmission mechanism PT. In this embodiment, the power transmission mechanism PT is a clutchless mechanism that includes, for example, a belt and a pulley. Alternatively, the mechanism PT may be a clutch mechanism (for example, an electromagnetic clutch) that selectively transmits power in accordance with the value of an externally supplied current.

A drive plate, which is a swash plate 12 in this embodiment, is accommodated in the crank chamber 5. The swash plate 12 has a hole formed in the center. The drive shaft 6 extends through the hole in the swash plate 12. The swash plate 12 is coupled to the lug plate 11 by a guide mechanism, which is a hinge mechanism 13 in this embodiment. The hinge mechanism 13 includes two support arms 14 (only one is shown) and two guide pins 15 (only one is shown). Each support arm 14 projects from the rear side of the lug plate 11. Each guide pin 15 projects from the swash plate 12. The swash plate 12 rotates integrally with the lug plate 11 and drive shaft 6. The swash plate 12 slides along the drive shaft 6 and tilts with respect to the axis of the drive shaft 6. The swash plate 12 has a counterweight 12*a* located at the opposite side of drive shaft 6 with respect to the drive hinge mechanism 13.

A spring 16 is located between the lug plate 11 and the swash plate 12. The spring 16 urges the swash plate 12 toward the cylinder block 1, or in the direction decreasing the inclination of the swash plate 12. The inclination of the swash plate 12 is defined by an inclination angle θ, which is the angle between the swash plate 12 and a plane perpendicular to the drive shaft 6. A stopper ring 18 is fixed on the drive shaft 6 behind the swash plate 12. A spring 17 is fitted about the drive shaft 6 between the stopper ring 18 and the swash plate 12. When the inclination angle θ is great as shown by broken line in FIG. 1, the spring 17 does not apply force to the swash plate 12 and other members. When the inclination angle θ is small, as shown by solid lines in FIG. 1, the spring 17 is compressed between the stopper ring 18 and the swash plate 12 and urges the swash plate 12 away from the cylinder block 1, or in a direction increasing the inclination angle θ. The normal length of the spring 17 and the location of the stopper ring 18 are determined such that the spring 17 is not fully contracted when the swash plate 12 is inclined by the minimum inclination angle θmin (for example, an angle from one to five degrees).

Cylinder bores 1*a* (only one shown) are formed in the cylinder block 1. The cylinder bores la are arranged at equal angular intervals about the drive shaft 6. The rear end of each cylinder bore 1*a* is blocked by the valve plate 3. A single headed piston 20 is reciprocally accommodated in each cylinder bore 1*a*. Each piston 20 and the corresponding cylinder bore 1*a* define a compression chamber, the volume of which is changed according to reciprocation of the piston 20. The front portion of each piston 20 is coupled to the swash plate 12 by a pair of shoes 19. Therefore, rotation of the swash plate 12 reciprocates each piston 20 by a stroke that corresponds to the angle θ.

A suction chamber 21 and a discharge chamber 22 are defined between the valve plate 3 and the rear housing member 4. The discharge chamber 22 surrounds the suction chamber 21. The valve plate 3 has suction ports 23 and discharge ports 25, which correspond to each cylinder bore 1*a*. The valve plate 3 also has suction valve flaps 24, each of which corresponds to one of the suction ports 23, and discharge valve flaps 26, each of which corresponds to one of the discharge ports 25. The suction ports 23 connect the suction chamber 21 with the cylinder bores 1*a*. The discharge ports 25 connect the cylinder bores 1*a* with the discharge chamber 22.

When each piston 20 moves from the top dead center position to the bottom dead center position, refrigerant gas in the suction chamber 21, which is a suction pressure zone, flows into the corresponding cylinder bore *a* via the corresponding suction port 23 and suction valve 24. When each piston 20 moves from the bottom dead center position to the top dead center position, refrigerant gas in the corresponding cylinder bore 1*a* is compressed to a predetermined pressure and is discharged to the discharge chamber 22, which is a discharge pressure zone, via the corresponding discharge port 25 and discharge valve 26.

Power of the engine E is transmitted to and rotates the drive shaft 6. Accordingly, the swash plate 12, which is inclined by an angle θ, is rotated. Rotation of the swash plate 12 reciprocates each piston 20 by a stroke that corresponds to the angle θ. As a result, suction, compression and discharge of refrigerant gas are repeated in the cylinder bores 1*a*.

The inclination angle θ of the swash plate 12 is determined according to various moments acting on the swash plate 12. The moments include a rotational moment, which is based on the centrifugal force of the rotating swash plate 12, a spring force moment, which is based on the force of the springs 16 and 17, a moment of inertia of the piston reciprocation, and a gas pressure moment. The gas pressure moment is generated by the force of the pressure in the cylinder bores 1*a* and the pressure in the crank chamber 5 (crank pressure Pc). The gas pressure moment is adjusted by changing the crank pressure Pc by a displacement control valve CV, which will be discussed below. Accordingly, the inclination angle θ of the plate 12 is adjusted to an angle between the maximum inclination emax and the minimum inclination θmin. The contact between the counterweight 12*a* and a stopper 11*a* of the lug plate 11 prevents further inclination of the swash plate 12 from the maximum inclination θmax. The minimum inclination θmin is determined based chiefly on the forces of the springs 16 and 17 when the gas pressure moment is maximized in the direction decreasing the swash plate inclination.

Figure 2:
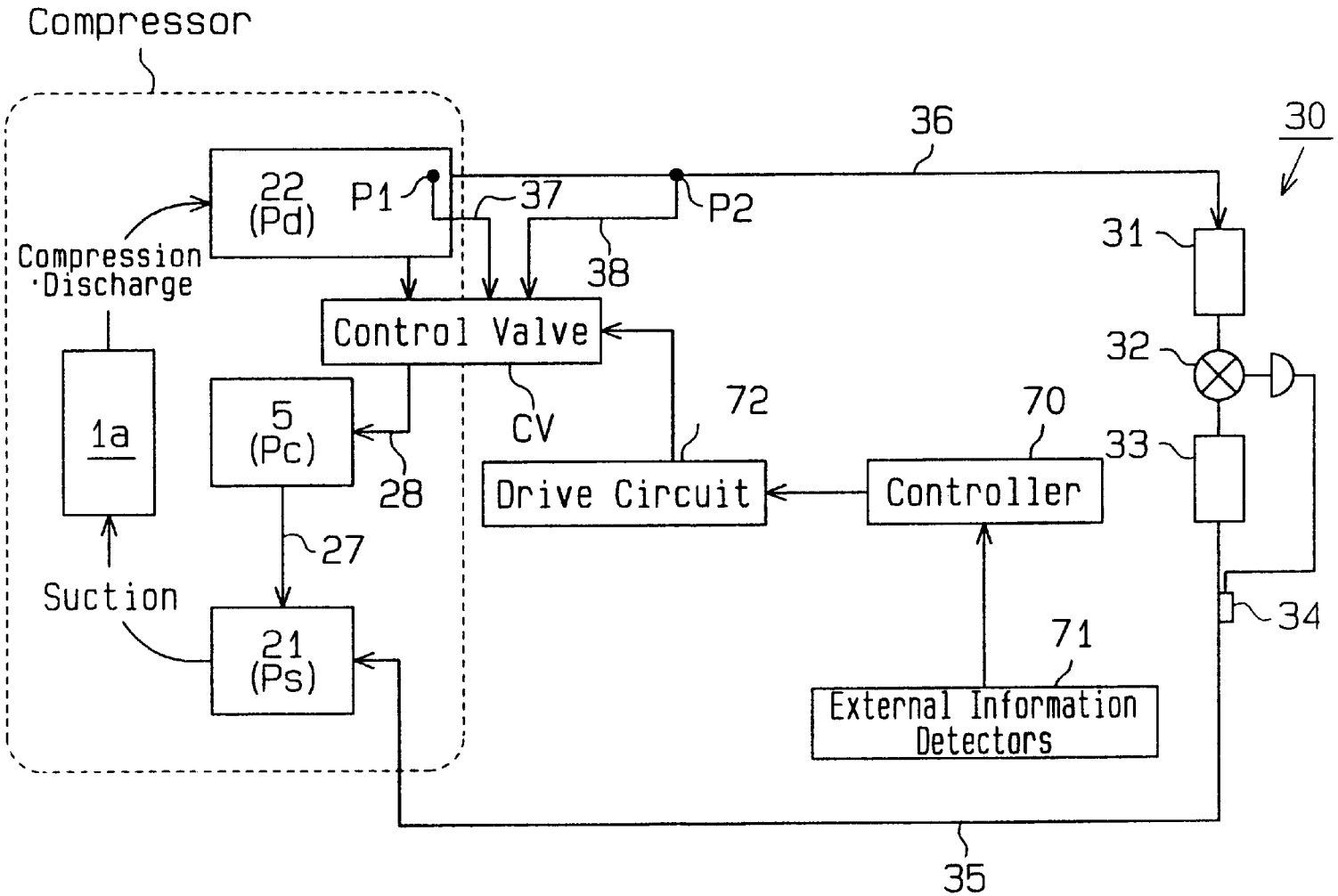
FIG. 2 is a circuit diagram schematically showing a refrigerant circuit of the first embodiment, a third embodiment, and a fourth embodiment.

A mechanism for controlling the crank pressure Pc includes a bleeding passage 27, a supply passage 28 and the control valve CV as shown in FIGS. 1 and 2. The passages 27, 28 are formed in the housing. The bleeding passage 27 connects the suction chamber 21 with the crank chamber 5. The supply passage 28 connects the discharge chamber 22 with the crank chamber 5. The control valve CV is located in the supply passage 28.

The control valve CV changes the opening of the supply passage 28 to adjust the flow rate of refrigerant gas from the discharge chamber 22 to the crank chamber 5. The crank pressure Pc is changed in accordance with the relationship between the flow rate of refrigerant gas from the discharge chamber 22 to the crank chamber 5 and the flow rate of refrigerant gas flowing out from the crank chamber 5 to the suction chamber 21 through the bleeding passage 27. The difference between the crank pressure Pc and the pressure in the cylinder bores 1*a* is changed in accordance with the crank pressure Pc, which varies the inclination angle θ of the swash plate 12. This alters the stroke of each piston 20 and the compressor displacement.

FIG. 1 illustrates a refrigeration circuit of a vehicle air-conditioning system. The refrigeration circuit has a swash plate type variable displacement compressor and an external refrigeration circuit 30. The refrigeration circuit 30 includes, for example, a condenser 31, an expansion valve 32 and an evaporator 33. The opening of the expansion valve 32 is feedback-controlled based on the temperature detected by a heat sensitive tube 34 at the outlet of the evaporator 33. The expansion valve 32 supplies refrigerant the amount of which corresponds to the thermal load to the evaporator 33 to regulate the flow rate. A line 35 is provided in a downstream portion of the external refrigerant circuit 30 for connecting the outlet of the evaporator 33 to the suction chamber 21 of the compressor. A line 36 is provided in an upstream portion of the external refrigerant circuit 30 for connecting the discharge chamber 22 of the compressor to the inlet of the condenser 31. The compressor draws refrigerant gas from the downstream portion of the refrigeration circuit 30 and compresses the gas. The compressor then discharges the compressed gas to the upstream portion of the circuit 30.

The greater the displacement of the compressor is, the higher the flow rate of refrigerant in the refrigeration circuit is. The greater the flow rate of the refrigerant, the greater the pressure loss per unit length in the circuit is. That is, the pressure loss between two points in the refrigeration circuit corresponds to the flow rate of refrigerant in the circuit. By detecting the pressure difference ΔP(t) (ΔP(t)=PsH−PsL) between two points P1, P2, the displacement of the compressor is detected indirectly. In this embodiment, the point P1 is located in the discharge chamber 22 and is an upstream pressure monitoring point. The point P2 is located in the line 36 at a position spaced from the point 1 by a predetermined distance and is a downstream pressure monitoring point. The gas pressure PdH at the point P1 is applied to the displacement control valve CV through a first pressure detecting passage 37. The gas pressure PdL at the point P2 is applied to the displacement control valve CV through a second pressure detecting passage 38. The displacement control valve CV performs a feedback control procedure for the compressor displacement in accordance with the pressure difference between the point P1 and the point P2 (PdH−PdL).

Figure 3:
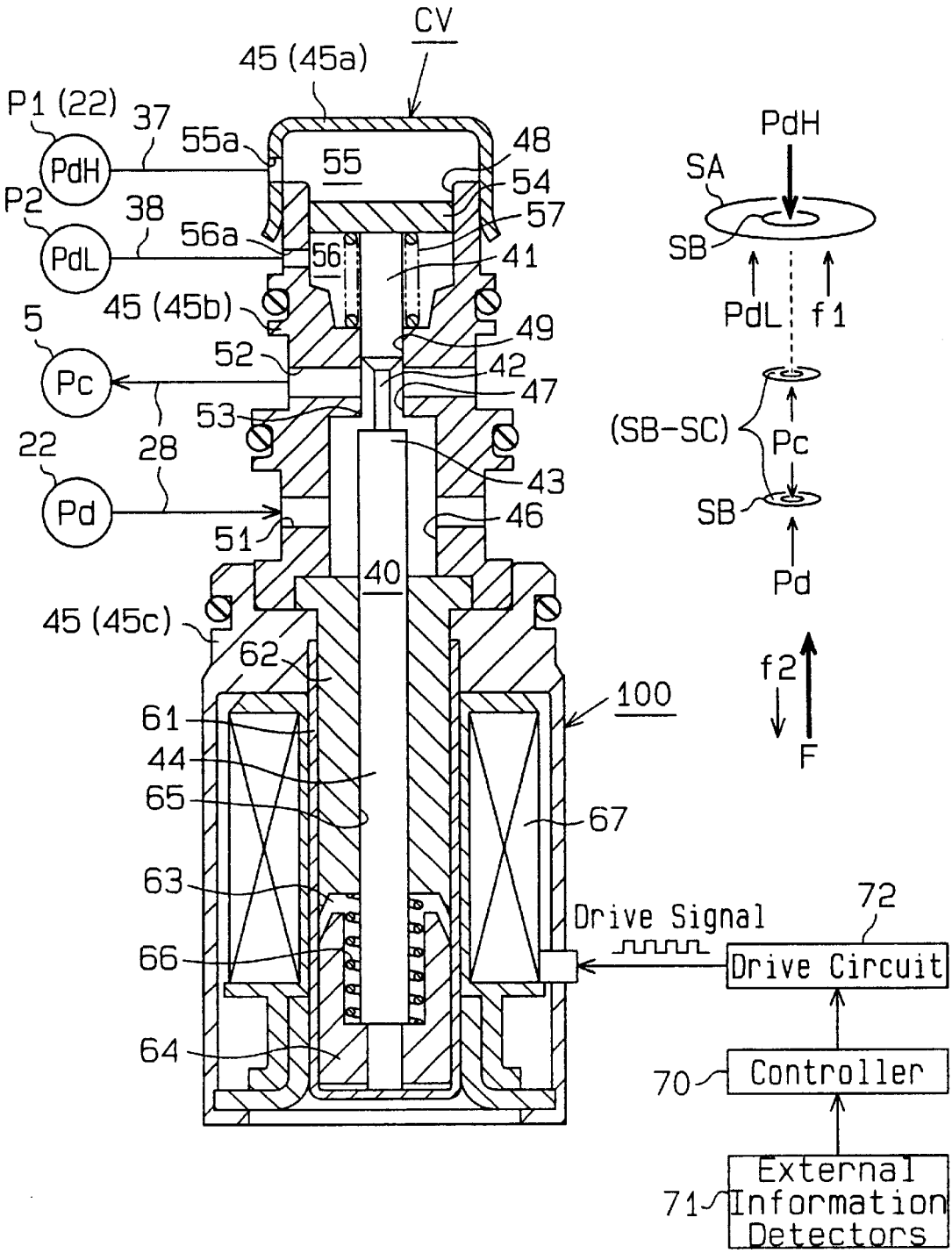
FIG. 3 is a cross-sectional view showing a displacement control valve provided in the compressor of FIG. 1.

As shown in FIG. 3, the control valve CV includes an inlet valve portion and a solenoid. The inlet valve portion adjusts the opening size of the supply passage 28 connecting the discharge chamber 22 to the crank chamber 5. The solenoid functions as an electromagnetic actuator 100 that controls a rod 40 provided in the control valve CV in accordance with an external electric current supply. A pressure difference receiving portion 41 is provided at a distal end of the rod 40. A valve body 43 is provided at a substantially intermediate portion of the rod 40. The pressure difference receiving portion 41 is connected to the valve body 43 by a connecting portion 42. The rod 40 further includes a guide portion 44. The valve body 43 forms part of the guide portion 44. The diameter d1 of the pressure difference receiving portion 41, the diameter d2 of the connecting portion 42, and the diameter d3 of the guide portion 44 (the valve body 43) satisfy the following condition: d2<d1<d3. The cross-sectional area SB of the pressure difference receiving portion 41 in a plane perpendicular to the axis of the rod 40 is $\pi(d1/2)^2$. The cross-sectional area SC of the connecting portion 42 in a plane perpendicular to the axis of the rod 40 is $\pi(d2/2)^2$. The cross-sectional area SD of the guide portion 44 (the valve body 43) in a plane perpendicular to the axis of the rod 40 is $\pi(d3/2)^2$, The control valve CV has a valve housing 45 including a cap 45*a*, an upper body section 45*b*, and a lower body section 45*c*, as shown in FIG. 3. A valve chamber 46 and a communication passage 47 are formed in the upper body section 45*b*. A pressure sensing chamber 48 is provided between the upper body section 45*b* and the cap 45*a*.

The rod 40 extends through the valve chamber 46, the communication passage 47, and the pressure sensing chamber 48 and moves along the axis of the control valve CV. The valve chamber 46 is selectively connected to and disconnected from the passage 47 in accordance with the position of the rod 40. The communication passage 47 is completely blocked from the pressure sensing chamber 48 by a wall forming part of the valve housing 45. The diameter of the passage 47 and the diameter of a guide hole 49 are equal to the diameter d1 of the pressure difference receiving portion 41 of the rod 40.

The bottom of the valve chamber 46 is formed by the upper surface of a fixed iron core 62. A port 51 extends radially from the valve chamber 46. The valve chamber 46 is connected to the discharge chamber 22 through the port 51 and the upstream portion of the supply passage 28. A port 52 radially extends from the communication passage 47. The communication passage 47 is connected to the crank chamber 5 through the downstream portion of the supply passage 28 and the port 52. Therefore, the port 51, the valve chamber 46, the communication passage 47 and the port 52, which are formed in the control valve CV, form a part of the supply passage 28, which connects the discharge chamber 22 with the crank chamber 5.

The valve body 43 of the rod 40 is located in the valve chamber 46. The diameter d1 of the communication passage 47 is larger than the diameter d2 of the connecting portion 42 of the rod 40 and is smaller than the diameter d3 of the large diameter the end portion 44. A valve seat 53 is formed about the opening of the communication passage 47, which functions as a valve hole. If the rod 40 is moved from the position shown in FIG. 3, or its lowest position, to its highest position, where the valve body 43 contacts the valve seat 53, the communication passage 47 is closed. That is, the valve body 43 of the rod 40 functions as an inlet valve body, which controls the opening size of the supply passage 28. In this description, upward is the direction in which the rod 40 closes the communication passage 47, and downward is the direction in which the rod 40 opens the passage 47.

An axially movable wall 54, or partition member, is provided in the pressure sensing chamber 48. The movable wall 54 axially divides the pressure sensing chamber 48 into two sections, or a P1 pressure chamber (first pressure chamber) 55 and a P2 pressure chamber (second pressure chamber) 56. The movable wall 54 separates the P1 pressure chamber 55 from the P2 pressure chamber 56. The P1 pressure chamber 55 is thus isolated from the P2 pressure chamber 56. The cross-sectional area SA of the movable wall 54 in a plane perpendicular to the axis of the rod 40 is greater than the cross-sectional area SB of the passage 47 or the guide hole 49 (SB<SA) perpendicular to the axis of the rod 40.

The P1 pressure chamber 55 is constantly connected to the discharge chamber 22, in which the point P1 is located, through a P1 port 55*a* formed in the cap 45*a* and the first pressure detecting passage 37. The P2 pressure chamber 56 is constantly connected to the point P2 through a P2 port 56*a,* which extends through the upper body section 45*b,* and the second pressure detecting passage 38. Accordingly, the discharge pressure Pd is introduced to the P1 pressure chamber 55 as the pressure PdH, and the pressure PdL at the point P2 located in the line 36 is introduced to the P2 pressure chamber 56. That is, the upper side of the movable wall 54 is exposed to the pressure PdH, and the lower side of the movable wall 54 is exposed to the pressure PdL, as viewed in FIG. 3. A distal end, or upper end, of the pressure difference receiving portion 41 of the rod 40 is located in the P2 pressure chamber 56. The movable wall 54 is secured to the distal end of the pressure difference receiving portion 41. A dampener spring 57 is provided in the P2 pressure chamber 56 for urging the movable wall 54 toward the P1 pressure chamber 55.

The solenoid, or the electromagnetic actuator 100, which controls the rod 40 in accordance with an external electric current supply, has an accommodating cylinder 61 with a closed end. The fixed iron core 62 is fitted in an upper section of the cylinder 61, and a solenoid chamber 63 is formed in the cylinder 61. The solenoid chamber 63 accommodates a movable iron core 64, or plunger. The movable core 64 axially moves in the solenoid chamber 63.

A guide hole 65 extends axially through the middle of the fixed core 62. The guide hole 65 accommodates the guide portion 44 of the rod 40. The guide portion 44 axially moves in the guide hole 65. A clearance (not shown) is defined between the wall of the guide hole 65 and the guide portion 44. The clearance connects the valve chamber 46 to the solenoid chamber 63. The solenoid chamber 63 thus receives the discharge pressure Pd. like the valve chamber 46.

A lower end of the guide portion 44, or the proximal end of the rod 40, is fitted in a hole formed in the middle of the movable core 64 and is fixed to the movable core 64. The movable core 64 thus moves integrally with the rod 40. A return spring 66 is provided between the fixed core 62 and the movable core 64. The return spring 66 urges the movable core 64 in a direction to separate the movable core 64 from the fixed core 62, or downward. That is, the return spring 66 functions as an initializing means that returns the movable core 64 and the rod 40 to their lowermost positions.

A coil 67 is wound around the fixed core 62 and the movable core 64. A drive circuit 72 sends a drive signal indicating a predetermined duty ratio Dt to the coil 67, in accordance with an instruction of a controller 70. The coil 67 then generates electromagnetic force F corresponding to the duty ratio Dt or in accordance with an external electric current supply to the coil 67. The electromagnetic force F attracts the movable core 64 toward the fixed core 62, thus moving the rod 40 upward. The electric current supply to the coil 67 may be controlled by an analog electric current control procedure, a duty control procedure, in which the duty ratio Dt is altered as necessary, or a pulse width modification control procedure (PWM control procedure). As the duty ratio Dt becomes smaller, the opening size of the control valve CV becomes larger. That is, as the duty ratio Dt becomes larger, the opening size of the control valve CV becomes smaller.

The opening size of the control valve CV of FIG. 3 is determined in accordance with the position of the rod 40 including the valve body 43. The operational conditions and characteristics of the control valve CV are determined in relation to the forces acting on various portions of the rod 40.

An upper side of the pressure difference receiving portion 41 of the rod 40 receives a downward force that is generated in accordance with the equilibrium of the pressure difference between the P1 pressure chamber 55 and the P2 pressure chamber 56 (PdH−PdL) and the upward force f1 of the dampener spring 57. The pressure receiving area of the upper side of the movable wall 54 is SA, and the pressure receiving area of the lower side of the movable wall 54 is SA−SB. Further, an upward force that is generated by the crank pressure Pc is applied to the lower side of the pressure difference receiving portion 41, the pressure receiving area of which is SB−SC. If the downward direction is considered to be the positive direction, a total force ΣF1 applied to the pressure difference receiving portion 41 is represented by the following equation (1):

$$\Sigma F1=PdH\cdot SA-PdL(SA-SB)-f1-Pc(SB-SC) \quad (1)$$

The guide portion 44 of the rod 40 receives an upward force that is generated in accordance with the equilibrium between the electromagnetic force F of the coil 67 and the downward force f2 of the return spring 66.

Figure 13:
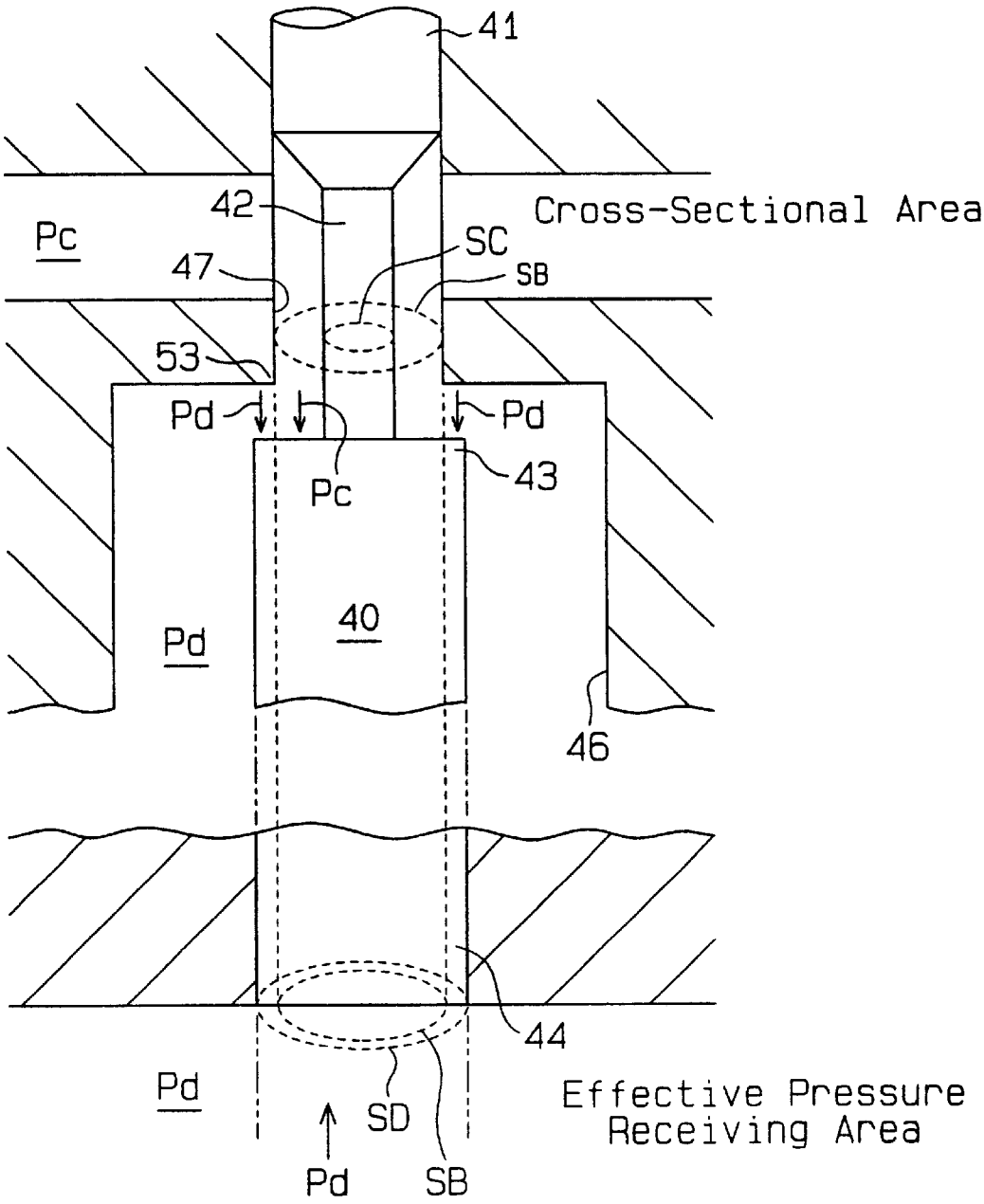
FIG. 13 is a cross-sectional view explaining an effective pressure-receiving area.
Figure 14:
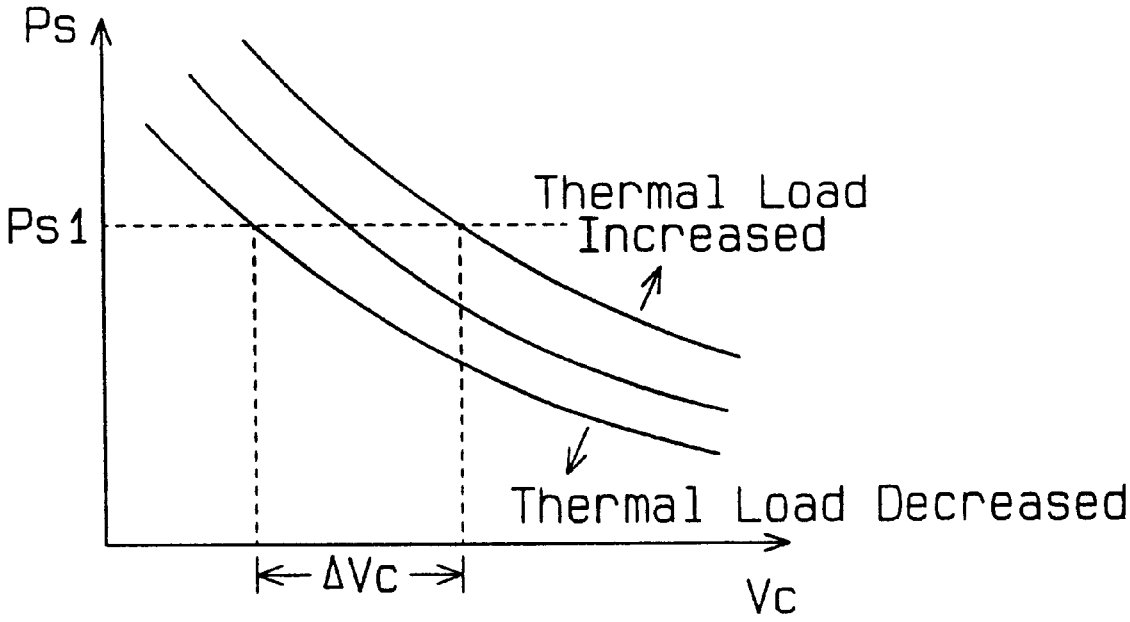
FIG. 14 is a graph representing the relationship between the suction pressure and the displacement.

The pressures acting on the valve body 43, the guide portion 44, and the movable core 64 will now be explained with reference to FIG. 13. The upper side of the valve body 43 is divided into two sections, an inner section and an outer section, with respect to a hypothetical cylindrical surface extending around the axis of the rod 40 and along the wall of the communication passage 47 (as indicated by broken lines in FIG. 13). As shown in FIG. 13, the crank pressure Pc applies axially downward force over a cross-sectional area SB−SC of the inner section, and the discharge pressure Pd applies axially downward force over a cross-sectional area SD−SB of the outer section. Further, the discharge pressure Pd applies an upward axial force to a lower side of the guide portion 44 over a cross-sectional area SD in a plane perpendicular to the axis of the guide portion 44. If the upward direction is considered to be the positive direction, the total force ΣF applied to the valve body 43 and the guide portion 44 is indicated by the following equation (2):

$$\Sigma F2=F-f2-Pc(SB-SC)-Pd(SD-SB)+Pd\cdot SD=F-F2-Pc(SB-SC)+Pd\cdot SB \quad (2)$$

If it is assumed that the discharge pressure Pd is applied only to the lower side of the guide portion 44 of the rod 40, equation (2) indicates that the effective pressure receiving area of the rod 40 is represented by the following equation: SD−(SD−SB)=SB. That is, the effective pressure receiving area of the guide portion 44, which receives the discharge pressure Pd, corresponds to the cross-sectional area SB of the passage 47, regardless of the cross-sectional area SD of the guide portion 44. When opposite ends of a rod or the like receive the same type of pressure, the difference between the opposed surfaces areas that receive the pressure is defined as the effective pressure receiving area.

Equation (2) is satisfied even if the cross-sectional area of the valve body 43 and that of the guide portion 44 is SB and the valve body 43 is inserted in the passage 47 (the cross-sectional area of which is SB), and if the crank pressure Pc acts on the upper side of the valve body 43 and the discharge pressure Pd is applied to the lower side of the guide portion 44.

The rod 40 is formed by the pressure difference receiving portion 41 and the guide portion 44 that are connected by the connecting portion 42. The rod 40 is thus positioned to satisfy the following condition: ΣF1=ΣF2. Based on equations (1), (2), the following equation (3) is obtained:

$$(PdH-PdL)SA-Pd\cdot SB+PdL\cdot SB=F-f2+f1 \quad (3)$$

In this embodiment, the point P1 is located in the discharge chamber 22. Accordingly, the following equation is satisfied: Pd=PdH. If this equation is applied to equation (3), equations (4), (5) are obtained.

$$(PdH-PdL)SA-(PdH-PdL)SB=F-f2+f1 \quad (4)$$

$$PdH-PdL=(F-f2+f1)/(SA-SB) \quad (5)$$

In equation (5), only the electromagnetic force F is varied in accordance with an electric current supplied to the coil 67. The opening size of the displacement control valve CV shown in FIG. 3 is adjusted by performing an external duty control procedure for the coil 67 to alter a target value for the pressure difference between P1 and P2, or ΔP(t)=PdH−PdL (which is a target pressure difference TPD). In other words, the control valve CV is externally controlled to alter the target pressure difference TPD. A target pressure difference determining means of the control valve CV shown in FIG. 3 is formed by the electronic actuator 100, the return spring 66, and the dampener spring 57.

Equation (5) does not have pressure parameters (values including Pc or Pd) other than the pressure difference between P1 and P2 (PdH−PdL). This indicates that the rod 40 is positioned regardless of the crank pressure Pc and the discharge pressure Pd. In other words, the rod 40 is positioned regardless of pressure parameters other than the pressure difference between P1 and P2. The control valve CV of FIG. 3 is thus smoothly operated only in relation to the equilibrium among the force caused by the pressure difference between P1 and P2 ΔP(t), the electromagnetic force F, and the urging forces f1, f2.

The operational characteristics of the displacement control valve of the first embodiment will hereafter be described. When the current supply to the coil 67 is null (Dt=0%), the return spring 66 maintains the rod 40 at its lowermost position, as shown in FIG. 3. In this state, the valve body 43 of the rod 40 is spaced from the valve seat 53 by a maximum distance. The inlet valve portion of the control valve CV is thus completely opened. If an electric current with a minimum duty ratio Dt is supplied to the coil 67, the upward electromagnetic force F becomes greater than the downward force f2 of the spring 66. The upward force (F−f2) matches a downward force determined by the equilibrium between the pressure difference between P1 and P2 (PdH−PdL) and the force f1 of the dampener spring 57. Accordingly, the valve body 43 is positioned with respect to the valve seat 53 to satisfy the equation (5), thus determining the opening size of the control valve CV. This determines the amount of gas flowing to the crank chamber 5 through the supply passage 28 and the amount of gas flowing from the crank chamber 5 through the bleeding passage 27. The crank pressure Pc is thus adjusted.

As long as the electromagnetic force F is constant, the control valve CV of FIG. 3 is operated with a target pressure difference TPD corresponding to the current electromagnetic force F. If the electromagnetic force F is altered in accordance with an external electric current supply, the control valve CV changes the target pressure difference TPD accordingly.

As shown in FIGS. 2 and 3, the vehicle air-conditioning apparatus includes the controller 70. The controller 70 includes a central processing unit (CPU), a read-only memory (ROM), a random access memory (RAM), and an input/output (I/O) interface. An external information detecting means 71 is connected to the input terminal of the I/O interface. A drive circuit 72 is connected to the output terminal of the I/O interface. The controller 70 computes a duty ratio Dt in accordance with various types of information supplied by the external information detecting means 71. The controller 70 then outputs a drive signal having the computed duty ratio Dt to the drive circuit 72. The drive circuit 72 sends the drive signal to the coil 67 of the control valve CV. The electromagnetic force F generated by the coil 67 is altered in accordance with the duty ratio Dt of the drive signal. That is, the solenoid of the control valve CV, the drive circuit 72, and the controller 70 form a target pressure altering means for altering the target pressure difference TPD in accordance with an external control signal.

The external information detecting means 71 includes, for example, an air-conditioner switch, a temperature sensor, a temperature selector, a vehicle speed sensor, an engine speed sensor, and an accelerator pedal sensor. Specifically, the air-conditioner switch is manipulated by a vehicle driver or passenger to turn the air conditioner on or off. The temperature sensor detects the temperature Te(t) in the passenger compartment, and the temperature selector is provided for selecting a desired target value Te(set) for the passenger compartment temperature. The vehicle speed sensor detects the vehicle speed V, and the engine speed sensor detects the engine speed NE. The accelerator pedal sensor detects an angle or opening size of a throttle valve provided in an intake manifold of the engine. The angle or opening size of the throttle valve reflects the depression amount of an accelerator pedal.

Figure 4:
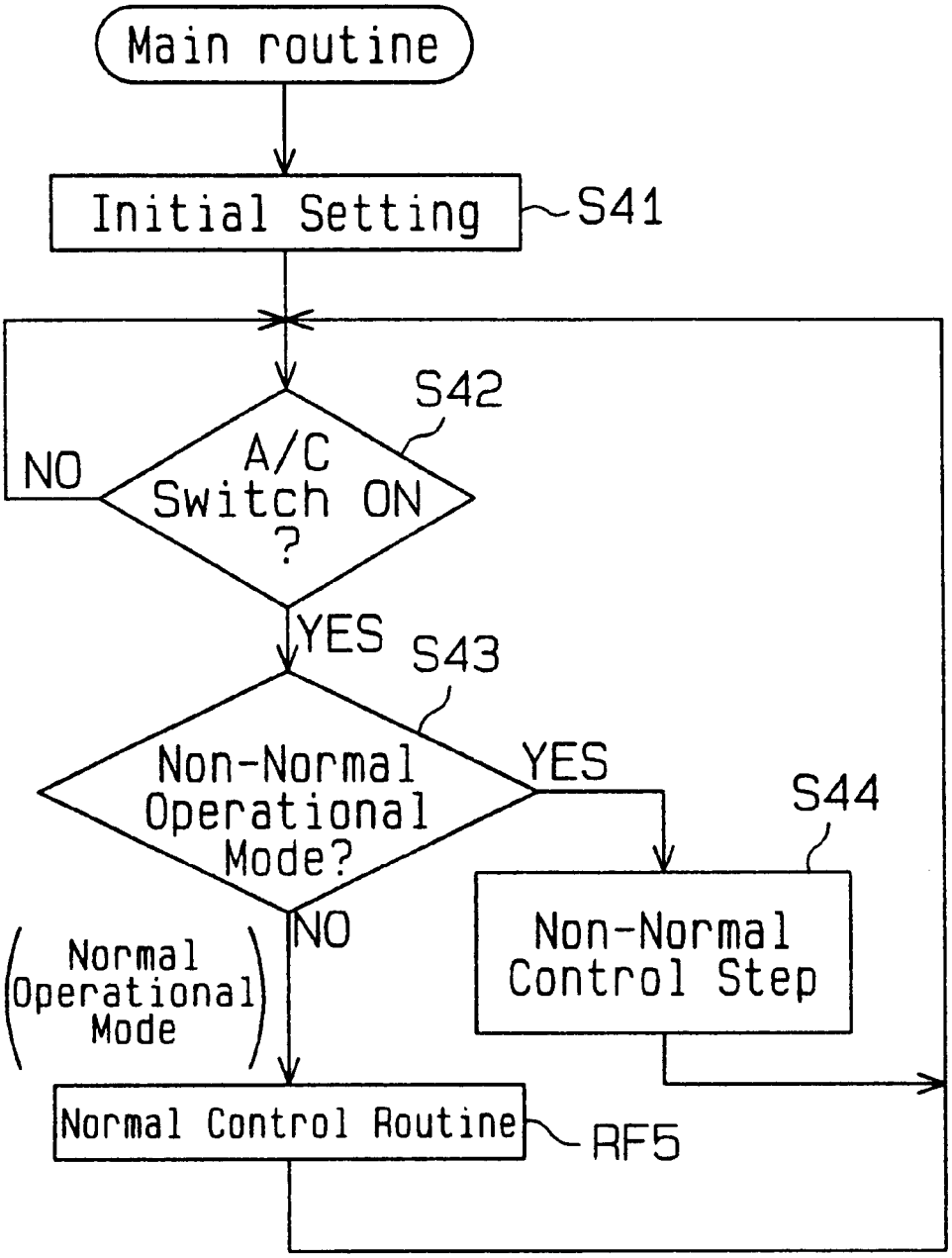
FIG. 4 is a flowchart showing a main routine for controlling the compressor displacement.
Figure 5:
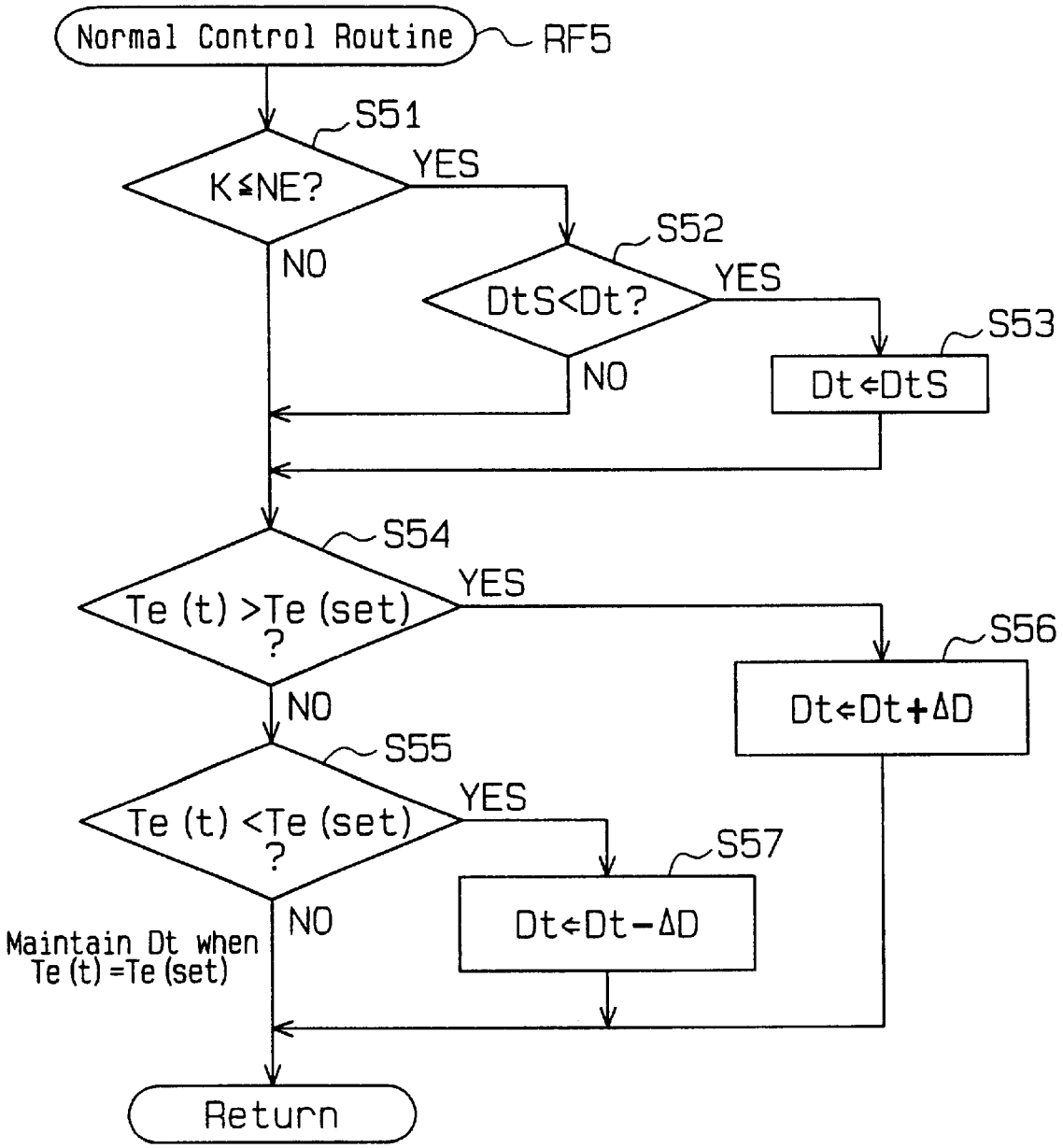
FIG. 5 is a flowchart of a normal control routine.

The duty control procedure for the control valve CV performed by the controller 70 will now described briefly with reference to the flowcharts of FIGS. 4 and 5.

The flowchart of FIG. 4 shows a main routine of the control procedure. Specifically, when an ignition switch (start switch) is turned on, an electric current is supplied to the controller 70. The controller 70 thus initiates computing. First, in S41, the controller 70 performs initial setting, or sets an initial or tentative value regarding, for example, the target pressure difference TPD of the control valve CV and the duty ratio Dt.

In S42, the controller 70 judges whether the air-conditioner switch is turned on or off. If the judgement of S42 is positive, or the air-conditioner switch is turned on, the controller 70 performs the judgement of S43. That is, in S43, the controller 70 judges, in accordance with external information, whether the vehicle is operating in a non-normal operational mode in which a non-normal compressor displacement control procedure must be performed. The non-normal displacement control procedure is performed when, for example, the vehicle is ascending a sloped surface, thus applying an increased load to the engine E. The non-normal displacement control procedure is also performed when the vehicle is accelerated, for example, to pass another vehicle. The controller 70 judges whether the vehicle is operating in the non-normal operational mode by comparing the current depression amount of the accelerator pedal, which is detected by the external information detecting means 71, with a predetermined determination value.

If the judgement of S43 is positive, the controller 70 executes the non-normal displacement control procedure (S44). That is, for example, after determining that an increased load is applied to the engine E or the vehicle is accelerated, the controller 70 maintains a duty ratio Dt of a drive signal at a predetermined value (zero) during a predetermined time period ΔT. As long as the duty ratio Dt is maintained at the minimum value, or during the time period ΔT, the opening size of the displacement control valve CV is maximum. Accordingly, the crank pressure Pc rapidly increases, and the inclination angle θ is minimized. This minimizes the compressor displacement, thus minimizing the load acting on the engine E. Further, since the predetermined time period ΔT is relatively short, the temperature in the passenger compartment is maintained at a comfortable level during this period.

If the judgement of step S43 is negative, or if the controller 70 determines that the vehicle is operating in a normal mode, a normal displacement control routine RF5 is performed. As shown in FIG. 4, after completing the normal control routine RF5, the judgement of step S42 is repeated by the controller 70.

The normal control routine RF5 of FIG. 5 is a feedback control procedure for controlling air-conditioning performance, or compressor displacement, when the vehicle is operating in the normal operational mode. The control valve CV automatically alters its opening size in accordance with the pressure difference ΔP(t)=PdH−PdL. In the routine RF5, a duty ratio Dt that reflects the target pressure difference TPD is altered in relation to the thermal load acting on the evaporator 33. Steps S51 to S53 prevent the compressor from seizing when the engine E is rotated at a relatively high speed. Steps S54 to S57 correct the target pressure difference TPD by altering the duty ratio Dt.

In S51, the controller 70 judges whether the engine speed NE is greater than a predetermined threshold value K. If the engine speed NE is greater than the threshold value K, the compressor may have operational problems such as seizing. The threshold value K is, for example, 5,000 rpm or 6,000 rpm. If the judgment of step S51 is positive, the controller 70 judges whether the current duty ratio Dt is greater than a predetermined safety value DtS in step S52. As long as the current duty ratio Dt is not greater than the safety value DtS, the current compressor displacement is not excessively high even if the engine E is rotating at a relatively high speed. The safety value DtS for the duty ratio Dt is, for example, 40% or 50%. If the judgements of steps S51 and S52 are both positive, or if the engine speed NE is greater than the threshold value K and the current duty ratio Dt is greater than the safety value DtS, the controller 70 instructs the drive circuit 72 to reduce the current duty ratio Dt to the safety value DtS in step S53. Accordingly, even when the engine speed NE is relatively high, or greater than the threshold value K, the compressor displacement is prevented from becoming too high. After completing the step S53, or if the judgement of step S51 or the judgement of step S52 is negative, the controller 70 performs step S54.

In step S54, the controller 70 judges whether temperature Te(t) detected by the temperature sensor is greater than a target temperature Te(set). If the judgment of step S54 is negative, the controller judges whether the detected temperature Te(t) is smaller than the target temperature Te(set) in step S55. If the judgement of step S55 is negative, it is indicated that the detected temperature Te(t) is equal to the target temperature Te(set). It is thus unnecessary to alter the duty ratio Dt, or the target pressure difference TPD. Accordingly, the controller 70 terminates the normal control routine RF5.

If the judgement of S54 is positive, it is indicated that the passenger compartment temperature Te(t) is relatively high and the thermal load acting on the evaporator 33 is relatively large. In this case, the controller 70 instructs the drive circuit 72 to increase the duty ratio Dt by a unit amount ΔD to a corrected value Dt+ΔD. This increases the electromagnetic force F generated by the solenoid, and the target pressure difference TPD of the control valve CV is also increased. Accordingly, the rod 40 is moved upward to contract the return spring 66 such that the downward force f2 of the return spring 66 matches the increased electromagnetic force F. In other words, the rod 40 is positioned to satisfy the equation (5). The opening size of the control valve CV, or the supply passage 28, is thus decreased. This reduces the crank pressure Pc, thus decreasing the difference between the crank pressure Pc and the pressure in each cylinder bore 1*a*. The inclination angle θ of the swash plate 12 is thus increased to raise the compressor displacement. In this state, the torque acting on the compressor is also increased. When the compressor displacement is increased, the cooling performance of the evaporator 33 increases. The passenger compartment temperature Te(t) is thus lowered, and the pressure difference between P1 and P2 is increased.

If the judgement of step S54 is negative and the judgement of step S55 is positive, it is indicated that the passenger compartment temperature Te(t) has fallen sufficiently and the thermal load acting on the evaporator 33 is relatively small. In this case, the controller 70 instructs the drive circuit 72 to decrease the duty ratio Dt by the unit amount ΔD to a corrected value Dt−AD. This decreases the electromagnetic force F generated by the solenoid, and the target pressure difference TPD of the control valve CV is also decreased. Accordingly, the rod 40 is moved downward to extend the return spring 66 such that the downward force f2 of the return spring 66 matches the decreased electromagnetic force F. In other words, the rod 40 is positioned to satisfy the equation (5). The opening size of the control valve CV, or the supply passage 28, is thus increased. This increases the crank pressure Pc, thus increasing the difference between the crank pressure Pc and the pressure in each cylinder bore 1*a*. The inclination angle θ of the swash plate 12 is thus decreased to reduce the compressor displacement. In this state, the torque acting on the compressor is also decreased. When the compressor displacement is reduced, the cooling performance of the evaporator 33 is decreased. The passenger compartment temperature Te(t) is thus raised, and the pressure difference between P1 and P2 is decreased.

As described, even if the detected temperature Te(t) does not correspond to the target temperature Te(set), the target pressure difference TPD is optimized by altering the duty ratio Dt in the steps S56 or S57. This adjusts the opening size of the control valve CV such that the passenger compartment temperature Te(t) reaches the target temperature Te(set).

The first embodiment has the following advantages.

In the first embodiment, the feedback control procedure for the compressor displacement is performed by directly adjusting the pressure difference between P1 and P2 in the refrigerant circuit, or ΔP(t)=PdH−PdL. Thus, unlike a case in which the opening size of the control valve CV is adjusted in accordance with the suction pressure Ps, the compressor of the present invention is not affected by the thermal load acting on the evaporator 33. Accordingly, the displacement is rapidly decreased in accordance with an external current supply when necessary, regardless of the thermal load acting on the evaporator 33.

When the vehicle is operated in the normal operational mode, the duty ratio Dt, which determines the target pressure difference TPD, is altered automatically in accordance with the detected temperature Te(t) and the target temperature Te(set) in steps S54 to S57 of FIG. 5. More specifically, the difference between the detected temperature Te(t) and the target temperature Te(set) is decreased by adjusting the opening size of the control valve in accordance with the pressure difference between P1 and P2 ΔP(t) to control the compressor displacement. Accordingly, the temperature in the passenger compartment is maintained at a desired level. That is, in the first embodiment, the compressor displacement is controlled to maintain the passenger compartment temperature at a comfortable level when the vehicle operates in the normal operational mode. Further, the compressor displacement is quickly altered when the vehicle operates in the non-normal operational mode.

The control valve CV of FIG. 3 automatically controls the compressor displacement, thus maintaining the pressure difference between P1 and P2 at a certain value. The control valve CV also alters the target pressure difference TPD in accordance with the electromagnetic force F varied in accordance with an external control procedure.

The cross-sectional area of the pressure difference receiving portion 41 is equal to the effective pressure receiving area of the guide portion 44, which is SB. The discharge pressure Pd (PdH) is introduced to the valve chamber 46, the solenoid chamber 63, and the Pi pressure chamber 55. As described above, the equation (5) includes no values defined by a single pressure parameter such as Pd(PdH) and PdL. The equation (5) indicates that the rod 40 is positioned in accordance with the pressure difference (PdH−PdL) and the forces f1, f2. In other words, the rod 40 is positioned regardless of pressure parameters other than the pressure difference (PdH−PdL). The control valve CV is thus controlled with improved accuracy.

As indicated by the equation (5), the rod 40 is positioned (the opening size of the control valve CV is adjusted) regardless of the crank pressure Pc. More specifically, the communication passage 47 and the guide hole 49 have equal cross-sectional areas SB. Accordingly, the upward force and downward force generated by the crank pressure Pc in the area between the communication passage 47 and the valve body 43 are cancelled by each other. The rod 40 is thus moved smoothly regardless of the crank pressure Pc.

Figure 6:
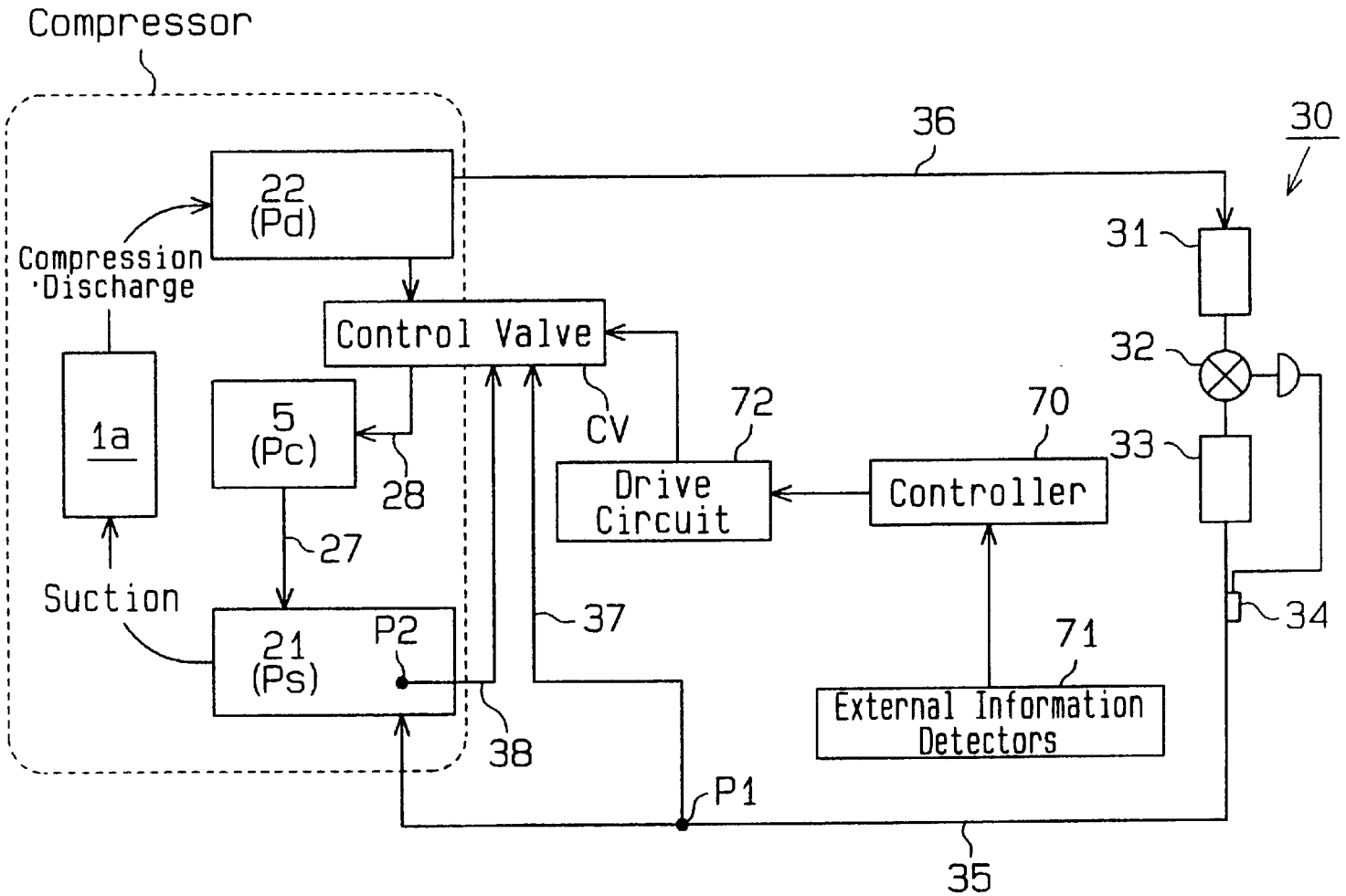
FIG. 6 is a circuit diagram schematically showing a refrigerant circuit of a second embodiment according to the present invention.
Figure 7:
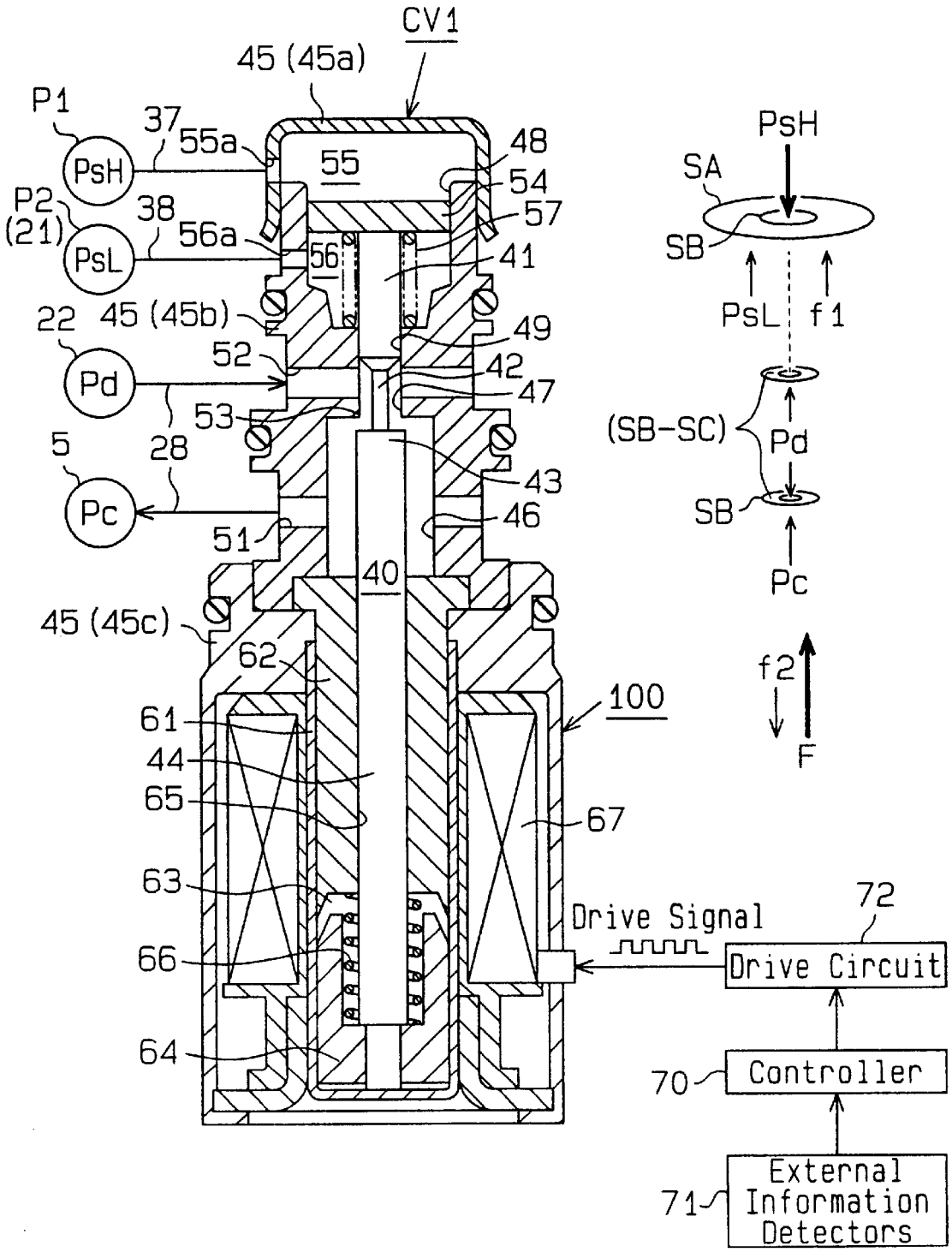
FIG. 7 is a cross-sectional view showing a displacement control valve of the second embodiment.

In the embodiment of FIGS. 1 to 5, the two pressure monitoring points P1, P2 are located along the line 36 connecting the discharge chamber 22 to the condenser 31. In a second embodiment, as shown in FIGS. 6 and 7, the points P1, P2 are located along the line 35 connecting the condenser 33 to the suction chamber 21 of the compressor. More specifically, the downstream pressure monitoring point P2 is located in the suction chamber 21, and the upstream pressure monitoring point P1 is located at a position spaced from P2 by a predetermined distance.

A control valve CV1 of FIG. 7 has the same mechanical structure as the control valve CV of FIG. 3. However, the pressure applied to the interior of the control valve CV1 is different from the pressure applied to the interior of the control valve CV. In the control valve CV1, the valve chamber 46 is connected to the crank chamber 5 through the port 51, and the communication passage 47 is connected to the discharge chamber 22 through the port 52. That is, refrigerant gas is drawn to the crank chamber 5 from the discharge chamber 22 through the valve chamber 46 and the communication passage 47. The pressure PsH at the point P1 shown in FIG. 6 is applied to the P1 pressure chamber 55, and the pressure PsL at the point P2 (or the suction pressure Ps) is applied to the P2 pressure chamber 56. Like the control valve CV of FIG. 3, the control valve CV1 of FIG. 7 functions as an inlet control valve varying a target pressure difference.

The opening size of the control valve CV1 is altered in accordance with the position of the rod 40 and the valve body 43, which is an inlet valve body.

The upper side of the pressure difference receiving portion 41 receives a downward force determined by the equilibrium of the pressure difference between the pressure PsH in the P1 pressure chamber 55 and the pressure PsL in the P2 pressure chamber 56 (PsH−PsL) and the upward force f1 of the dampener spring 57. The lower side of the pressure difference receiving portion 41 receives an upward force generated by the discharge pressure Pd. If the downward direction is defined as the positive direction, the total force EF1 applied to the pressure difference receiving portion 41 is represented by the following equation (6):

$$\Sigma F1 = PsH \cdot SA - PsL(SA - SB) - f1 - Pd(SB - SC) \quad (6)$$

The guide portion 44 of the rod 40 receives an upward force determined by the equilibrium between the electromagnetic force F and the downward force f2 of the return spring 66. Like the first embodiment, the effective pressure receiving areas of the valve body 43, the guide portion 44, and the movable core 64, which receives the crank pressure Pc, are equal to the cross-sectional area SB of the communication passage 47. The guide portion 44 receives an upward force Pc·SB. The upper side of the valve body 43 receives a downward force generated by the discharge pressure Pd. If the upward direction is defined as the positive direction, the total force ΣF2 applied to the valve body 43 and the guide portion 44 is represented by the following equation (7).

$$\Sigma F2=F-f2+Pc-SB-Pd(SB-SC) \quad (7)$$

Like the control valve CV of FIG. 3, the rod 40 is positioned to satisfy the condition: ΣF1=ΣF2. The following equation (8) is obtained from equations (6), (7):

If the compressor displacement is maintained at a relatively high level, the difference between the crank pressure Pc and the suction pressure Ps(PsL) is decreased. In this case, it is considered that the value SB in equation (8) is infinitesimal. The following approximate equation (9) is thus satisfied. Equation (10) is obtained from equation (9).

$$(PsH-PsL)SA\approx F-f2+f1 \quad (9)$$

$$PsH-PsL\approx(F-f2+f1)/SA \quad (10)$$

In the equation (10), only the electromagnetic force F is varied in accordance with a current supplied to the coil 67. The indication of equation (10) is equivalent to that of equation (5). It is thus indicated that the physical characteristics of the control valve CV1 of FIG. 7 are equivalent to those of the control valve CV of FIG. 3. Equation (10), which is satisfied when the rod 40 of the control valve CV1 is positioned, includes no parameters indicating pressure (including Pc and Pd) other than the pressure difference between P1 and P2 (PsH−PsL). Thus, like the first embodiment, the control valve CV1 of FIG. 7 operates smoothly in accordance with the pressure difference between P1 and P2 (PsH−PsL), the electromagnetic force F, and the spring forces f1, f2.

Like the first embodiment, the rod 40 of the control valve CV1 shown in FIG. 7 is positioned regardless of the discharge pressure Pd. The control valve CV1 of the second embodiment thus operates in a stable manner.

Figure 8:
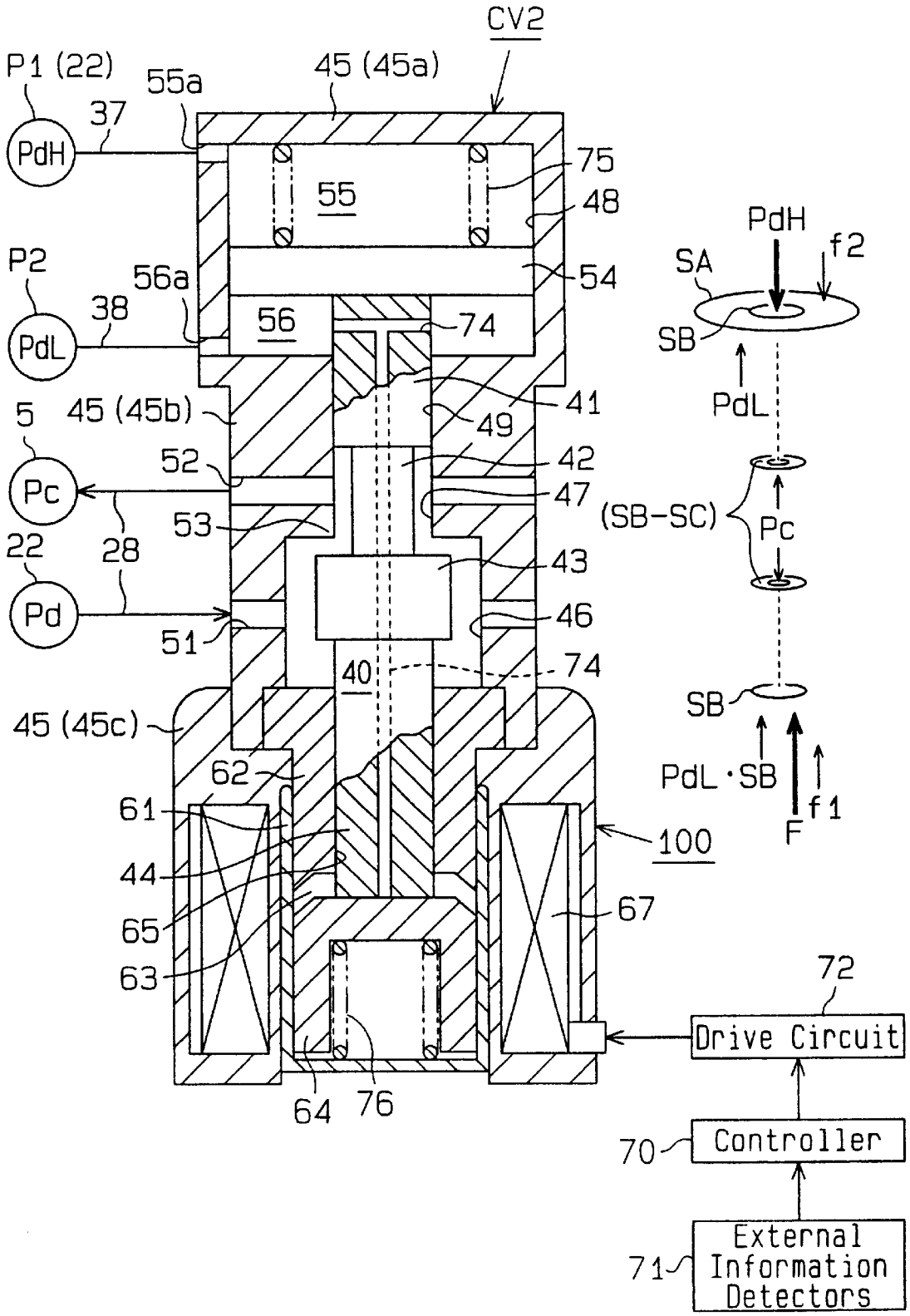
FIG. 8 is a cross-sectional view showing a displacement control valve of a third embodiment according to the present invention.

FIG. 8 shows a displacement control valve CV2 of a third embodiment. Same or like reference numerals are given to parts in FIG. 8 that are the same as or like corresponding parts in FIGS. 1 to 7. A detailed description of the parts are thus omitted.

The valve housing 45 accommodates the axially movable rod 40. The rod 40 includes the pressure difference receiving portion 41, the connecting portion 42, the valve body 43, and the guide portion 44. The diameter of the pressure difference receiving portion 41 is equal to that of the guide portion 44. The cross-sectional area of the pressure receiving portion 41 is equal to that of the guide portion 44, which is SB. The cross-sectional area of the connecting portion 42 is SC.

An internal passage 74 extends through the rod 40 and connects the pressure difference receiving portion 41 to the lower end of the rod 40. Like the control valve CV of FIG. 3, the discharge pressure Pd is introduced to the P1 pressure chamber 55 as PdH, and the pressure at the point P2 of FIG. 2 is introduced to the P2 pressure chamber 56 as PdL. The pressure PdL is introduced to the solenoid chamber 63 through the internal passage 74.

A return spring 75 is provided in the P1 pressure chamber 55 and enables the movable body 54 to abut against the pressure difference receiving portion 41. The return spring 75 urges the rod 40 downward through the movable wall 54. A retainer spring 76 is provided in the solenoid chamber 63. The retainer spring 76 causes the movable core 64 to abut against the guide portion 44. The retainer spring 76 urges the rod 40 upward through the movable core 64. The force f2 of the return spring 75 is larger than the force of the retainer spring 76.

The pressure difference receiving portion 41 receives the downward urging force f2 of the return spring 75, the downward force [PdH·SA]−[PdL(SA−SB)] due to the difference between the pressures in the P1 and P2 pressure chamber 55, 56, and the upward force caused by the crank pressure Pc. The pressure receiving area of the lower side of the pressure difference receiving portion 41 is SB−SC. If the downward direction is defined as the positive direction, the total force ΣF1 applied to the pressure difference receiving portion 41 is represented by the following equation (11).

$$\Sigma F1=f2+PdH-SA-PdL(SA-SB)-Pc(SB-SC) \quad (11)$$

The guide portion 44 and a portion of the valve body 43 receive the downward force generated by the crank pressure Pc, the upward electromagnetic force F, and the upward force f1 of the retainer spring 76. The effective pressure receiving area that receives the pressure PdL corresponds to the cross-sectional area SB of the guide portion 44. The guide portion 44 receives the upward force PdL·SB. If the upward direction is defined as the positive direction, the total force ΣF2 applied to the valve body 43 and the guide portion 44 is represented by the following equation (12).

$$\Sigma F2=F+f1+PdL\cdot SB-Pc(SB-SC) \quad (12)$$

The rod 40 is an integral body formed by the pressure difference receiving portion 41 and the valve body 43 that are connected by the connecting portion 42. The rod 40 is thus positioned to satisfy the condition: ΣF1=ΣF2. The pressure difference receiving portion 41 and the valve body 43, which receive the crank pressure Pc, have an equal pressure receiving area (SB−SC). Thus, the movement of the rod 40 is not affected by the crank pressure Pc. Accordingly, the following equation (13) is satisfied.

$$PdH\cdot SA-PdL(SA-SB)=F+f1-f2+PdL\cdot SB \quad (13)$$

The following equations (14), (15) are obtained from the equation (13).

$$PdH\cdot SA-PdL\cdot SA=F+f1-f2 \quad (14)$$

$$PdH-PdL=(F+f1-f2)/SA \quad (15)$$

The indication of equation (15) is equivalent to that of equation (5). It is thus indicated that the physical characteristics of the control valve CV2 of FIG. 8 are equivalent to those of the control valve CV of FIG. 3. In other words, the return spring 75 of FIG. 8 is equivalent to the return spring 66 of FIG. 3, and the retainer spring 76 of FIG. 8 is equivalent to the dampener spring 57 of FIG. 3. Like the control valve CV of FIG. 3, the control valve CV2 of FIG. 8 varies a target pressure difference. In the control valve CV2 of FIG. 8, a target pressure determining means is formed by the actuator 100, the return spring 75, and the retainer spring 76.

The rod 40 is positioned regardless of the crank pressure Pc, the discharge pressure Pd (PdH), and the pressure PdL.

Accordingly, the displacement control valve CV2 of FIG. 8 operates smoothly in accordance with the pressure difference between P1 and P2 ΔP(t), the electromagnetic force F, and the forces f1, f2.

The pressure applied to the area adjacent to the lower end of the rod 40 shown in FIG. 3 is PdH, which is the pressure in the P1 pressure chamber 55. The pressure applied to the area adjacent to the lower end of the rod 40 shown in FIG. 8 is PdL, which is the pressure in the P2 pressure chamber 56. The denominator of the equation (5) is thus different from that of the equation (15). However, in the control valve CV of the first embodiment and the control valve CV2 of the third embodiment, regardless of which pressure is introduced to the area adjacent to the lower end of the rod 40, the pressure received by one end of the rod 40 is cancelled by the pressure received by the other end of the rod 40. Accordingly, the rod 40 is positioned only in accordance with the pressure difference between PdH and PdL.

Figure 9:
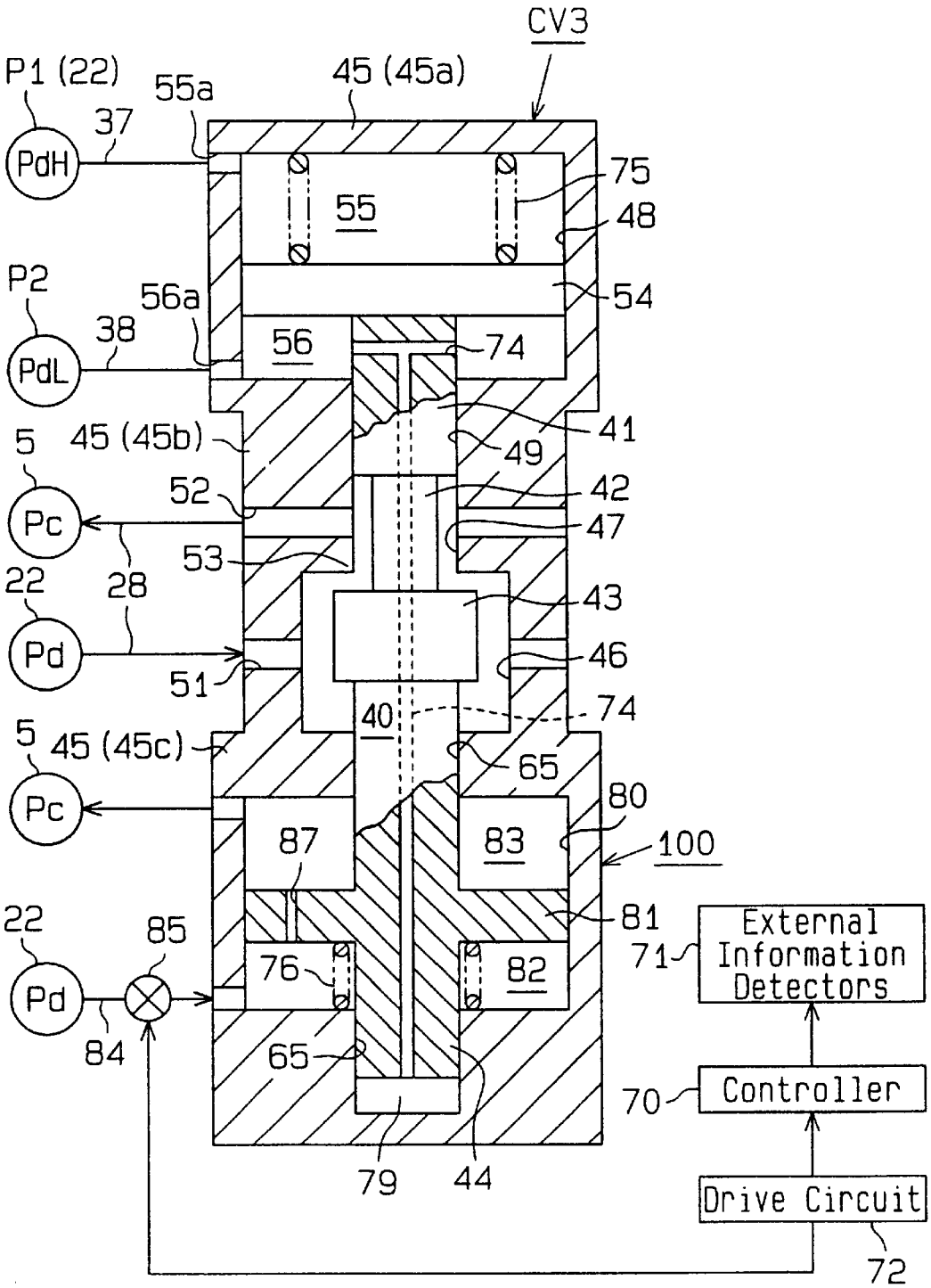
FIG. 9 is a cross-sectional view showing a displacement control valve of a fourth embodiment according to the present invention.

FIG. 9 shows a displacement control valve CV3 of a fourth embodiment according to the present invention. The control valve CV3 is a modification of the control valve CV2 of FIG. 8 and employs a spool in a solenoid as an actuator.

An actuating chamber 80 is formed in a lower section 45*c* of the valve housing. A flange-like spool 81 is accommodated in the actuating chamber 80. The spool 81 is formed integrally with a rod 40 and moves along the axis of the control valve CV3. The spool 81 divides the actuating chamber 80 into a high pressure chamber 82 and a low pressure chamber 83. The low pressure chamber 83 is connected to the crank chamber 5. The high pressure chamber 82 is connected to a zone in which the discharge pressure Pd acts, for example, the discharge chamber 22, through a passage 84. A valve 85 is provided in the passage 84 and is controlled by the controller 70. The retainer spring 76 is provided between the spool 81 and a wall of the high pressure chamber 82. Like the third embodiment shown in FIG. 8, the retainer spring 76 urges the rod 40 upward through the spool 81. A restricting passage 87 extends through the spool 81 and connects the high pressure chamber 82 to the low pressure chamber 83.

When the rod 40 is moved upward, the controller 70 instructs the drive circuit 72 to open the valve 85 for a predetermined time. The discharge gas, the pressure of which is the discharge pressure Pd, is thus applied to the high pressure chamber 82. In this state, the restricting passage 87 prevents the pressure in the high pressure chamber 82 from rapidly decreasing. The difference between the pressure in the high pressure chamber 82 and that of the low pressure chamber 83 is thus increased. This eventually moves the rod 40 upward against the downward force of the return spring 75. When the controller 70 instructs the drive circuit 72 to close the valve 85, the gas in the high pressure chamber 82 flows to the crank chamber 5 through the restricting passage 87 and the low pressure chamber 83. The spool 81 is then moved downward due to the downward force of the return spring 75. The rod 40 is thus positioned in accordance with the force of the return spring 75. As described, the solenoid of the control valve CV3 shown in FIG. 9 functions as the actuator 100.

In the control valve CV3, the internal passage 74 connects an area around the distal, or upward, end of the rod 40 (the P2 pressure chamber 56) to an area 79 adjacent to the proximal end of the rod 40. The cross-sectional area of the distal end of the rod 40 is equal to the cross-sectional area of the proximal end of the rod 40, which is SB. Thus, like the control valve CV2 of FIG. 8, the rod 40 is positioned independently of the pressure parameter PdL. Further, the rod 40 is not affected by the crank pressure Pc acting between the pressure difference receiving portion 41 and the valve body 43 or that acting around the connecting portion 42. Accordingly, also in the control valve CV3 of the fourth embodiment, the rod 40 is reliably positioned.

Figure 10:
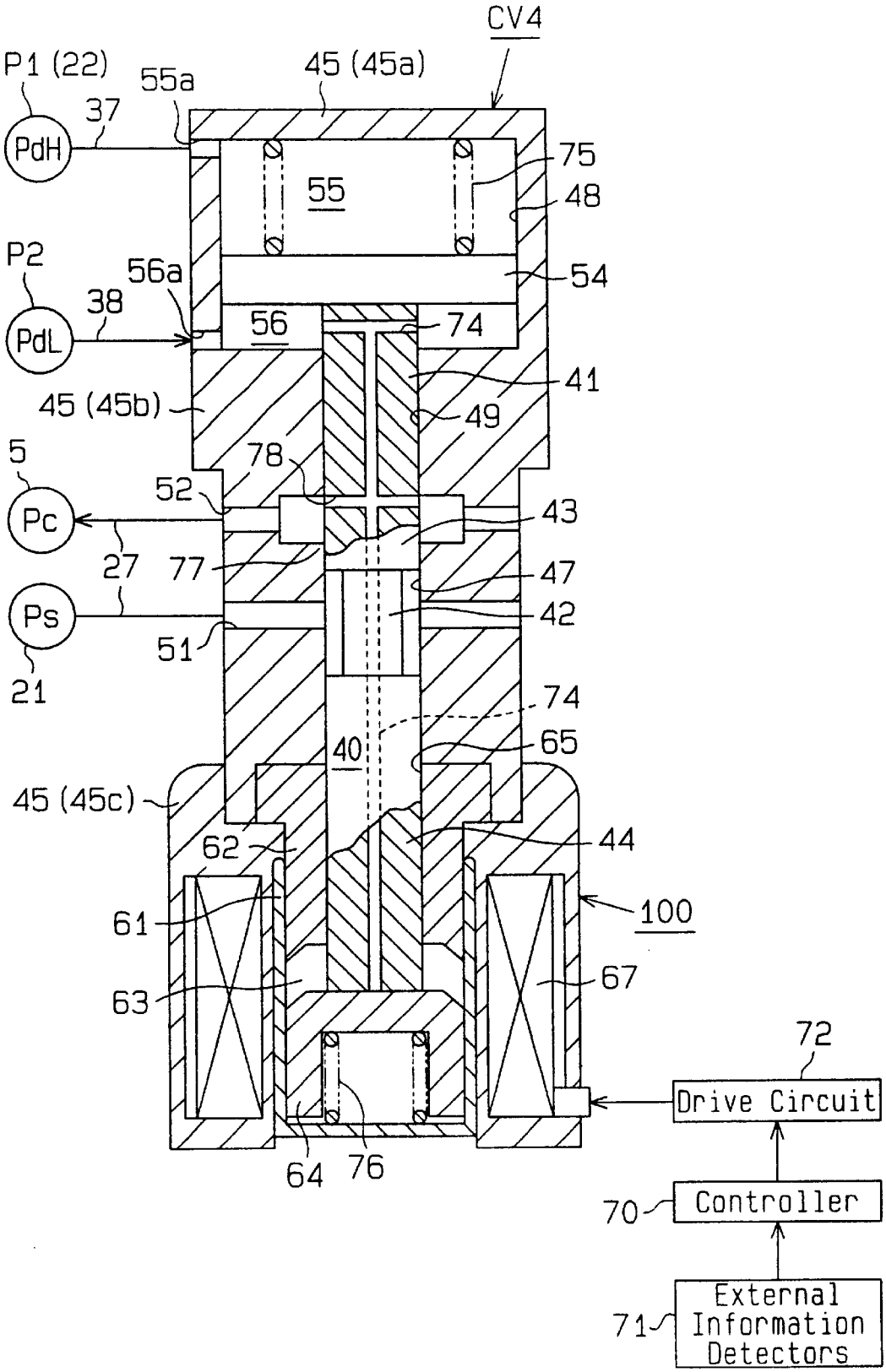
FIG. 10 is a cross-sectional view showing a displacement control valve of a fifth embodiment according to the present invention.
Figure 11:
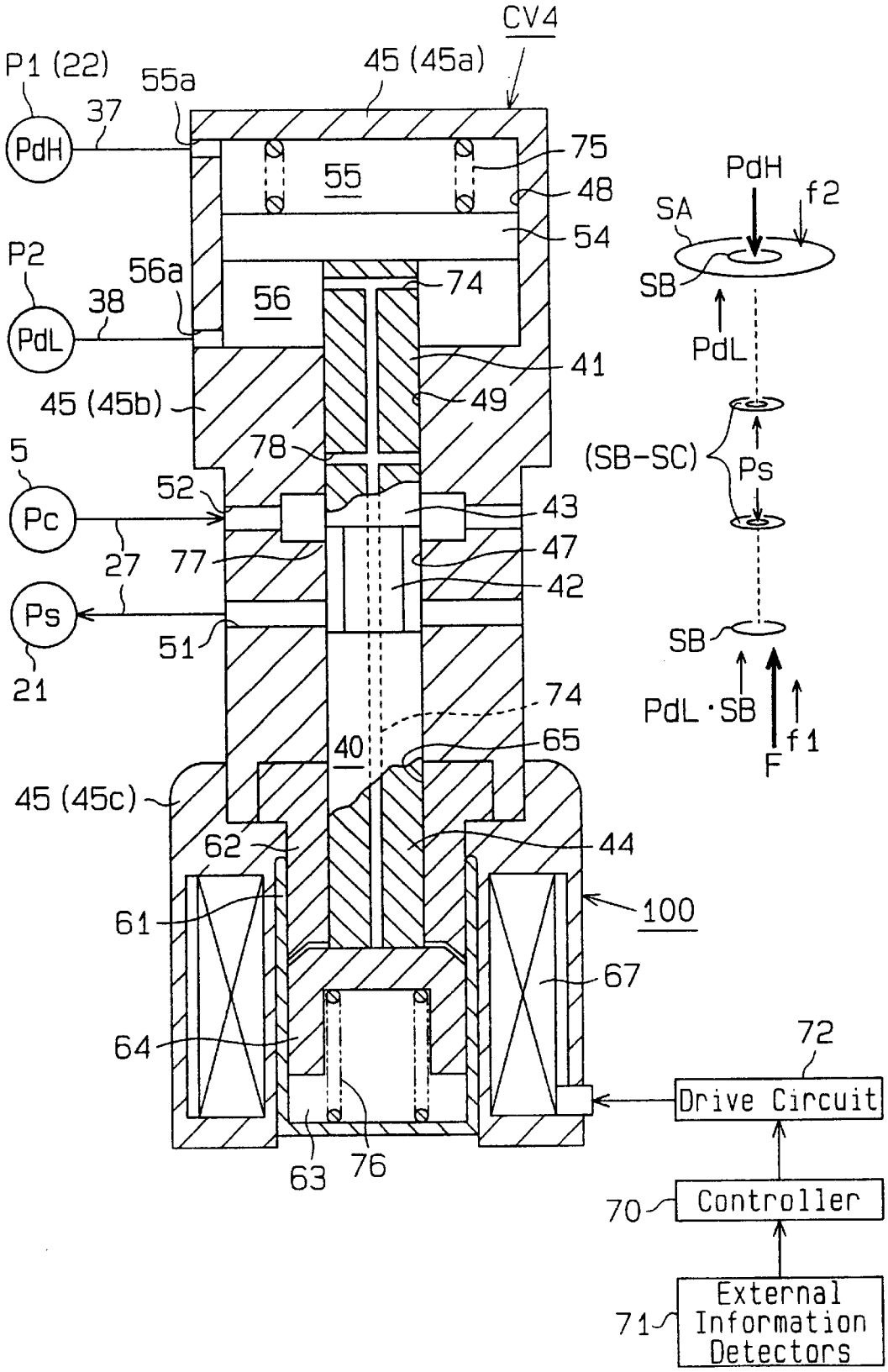
FIG. 11 is a cross-sectional view showing the displacement control valve of the fifth embodiment according to the present invention.

FIGS. 10 and 11 show a displacement control valve CV4 of a fifth embodiment. The control valve CV4 is a three-direction type displacement control valve. That is, while functioning as an inlet control valve that controls the amount of gas flowing to the crank chamber 5, the control valve CV4 functions as an outlet control valve that controls the amount of gas flowing from the crank chamber 5. Same or like reference numerals are given to parts in FIGS. 10 and 11 that are the same as or like corresponding parts of the control valves CV, CV1, CV2, CV3 of FIGS. 3, 7, 8, and 9. A detailed description of these parts is thus omitted.

The rod 40 is accommodated in the valve housing 45 and moves axially in the housing 45. The rod 40 includes the pressure difference receiving portion 41, the valve body 43, the connecting portion 42, and the guide portion 44. The pressure difference receiving portion 41 is provided at the distal end of the rod 40, and the guide portion 44 is provided at the proximal end of the rod 40. The valve body 43 is formed integrally with the pressure difference receiving portion 41. The connecting portion 42 connects the valve body 43 to the guide portion 44. The pressure difference receiving portion 41, the valve body 43, and the guide portion 44 have equal diameters and equal cross-sectional areas SB. The cross-sectional area of the connecting portion 42 SC, is smaller than the area SB. A portion of the pressure receiving portion 41 is received in the P2 pressure chamber 56, and a portion of the guide portion 44 is received in the solenoid chamber 63. The internal passage 74 extends through the rod 40 and connects the P2 pressure chamber 56 to the solenoid chamber 63.

The guide hole 49 extends axially in the valve housing 45. The communication passage 47 functions also as a valve chamber. The guide hole 65 extends through the fixed core 62. The guide holes 49, 65 and the communication passage 47 have equal inner diameters, which are substantially equal to the outer diameter of the pressure difference receiving portion 41. The guide holes 49, 65 and the communication passage 47 have equal cross-sectional areas SB.

A lower portion of the communication passage 47 is connected to the suction chamber 21 through the port 51. An upper portion of the communication passage 47 is connected to the crank chamber 5 through the port 52. As shown in FIG. 10, the port 52 (or the upper portion of the communication passage 47) is disconnected from the port 51 (or the lower portion of the communication passage 47) due to the location of the valve body 43 of the rod 40. As shown in FIG. 11, when the port 51 is connected to the port 52, the displacement control valve CV4 functions as the outlet control valve. In other words, the opening size of the bleeding passage 27 is controlled in relation to the size of a restriction passage formed by a step 77 and the valve body 43, or the opening size of the port 51. The amount of gas flowing from the crank chamber 5 to the suction chamber 21 is thus adjusted.

A second inner passage 78 is provided in the valve body 43 and extends from the internal passage 74 in a radial direction of the rod 40. As shown in FIG. 11, the second internal passage 78 is closed by the wall of the guide hole 49. In contrast, as shown in FIG. 10, when the lower side of the valve body 43 is located below the step 77 and the bleeding passage 27 is closed, the second internal passage 78 is connected to the port 52. In this state, the pressure monitoring point P2 is connected to the crank chamber 5 through the pressure detecting passage 38, the port 56*a,* the P2 pressure chamber 56, the internal passage 74, the second internal passage 78, the port 52, and the upstream portion of the bleeding passage 27. The gas at the point P2, the pressure of which is PdL, is thus introduced to the crank chamber 5. In other words, the control valve CV4 functions as the inlet control valve when the control valve CV4 is operated in the state shown in FIG. 10. The pressure PdL in the P2 pressure chamber 56 is applied to the solenoid chamber 63 through the internal passage 74.

The operation of the control valve CV4 of FIGS. 10 and 11 is described below.

When the current supplied to the solenoid 100 is null, the upward electromagnetic force F is also null. The downward force of the return spring 75 thus exceeds the upward force of the retainer spring 76. Accordingly, the rod 40 is located in the lowermost position (initial position), as shown in FIG. 10. In this state, the control valve CV4 functions as the inlet valve and is fully open. The gas at the pressure monitoring point P2 (see FIG. 2) is thus introduced to the crank chamber 5 through the internal passages 74, 78. This increases the crank pressure Pc.

When an electric current with a minimum duty ratio is supplied to the solenoid 100, the rod 40 is moved upward. The second internal passage 78 is thus closed by the wall of the guide hole 49. In this state, the control valve CV4 functions as the outlet control valve and varies the target pressure difference TPD. Like the fourth embodiment, the opening size of the bleeding passage 27, which varies in relation to the size of the restriction passage formed by the step 77 and the valve body 43, is determined in accordance with the difference between the target pressure difference TPD and the actual pressure difference between P1 and P2 (PdH−PdL). The target pressure difference TPD is varied by performing the duty control procedure for the electromagnetic force F.

As shown in FIG. 11, the suction pressure Ps acts in the area around the connecting portion 42. The upward force Ps(SB−SC) applied to the valve body 43 by the suction pressure Ps is cancelled by the downward force Ps(SB−SC) applied to the guide portion 44 by the suction pressure Ps. While the suction pressure Ps acts in the area around the connecting portion 42 of FIG. 11, the crank pressure Pc acts in the area around the connecting portion 42 of FIG. 8. However, the force acting on the rod 40 of FIG. 11 has the same characteristics as the force acting on the rod 40 of FIG. 8. Accordingly, like the control valve of FIG. 8, the control valve CV4 of FIGS. 10 and 11 varies the compressor displacement by altering the pressure difference PdH−PdL in accordance with the target pressure difference TPD as long as the target pressure difference TPD is not externally altered.

The control valve CV4 of FIGS. 10 and 11 has the same advantages as the control valve CV of FIG. 3 and the control valve CV 2 of FIG. 8.

Figure 12:
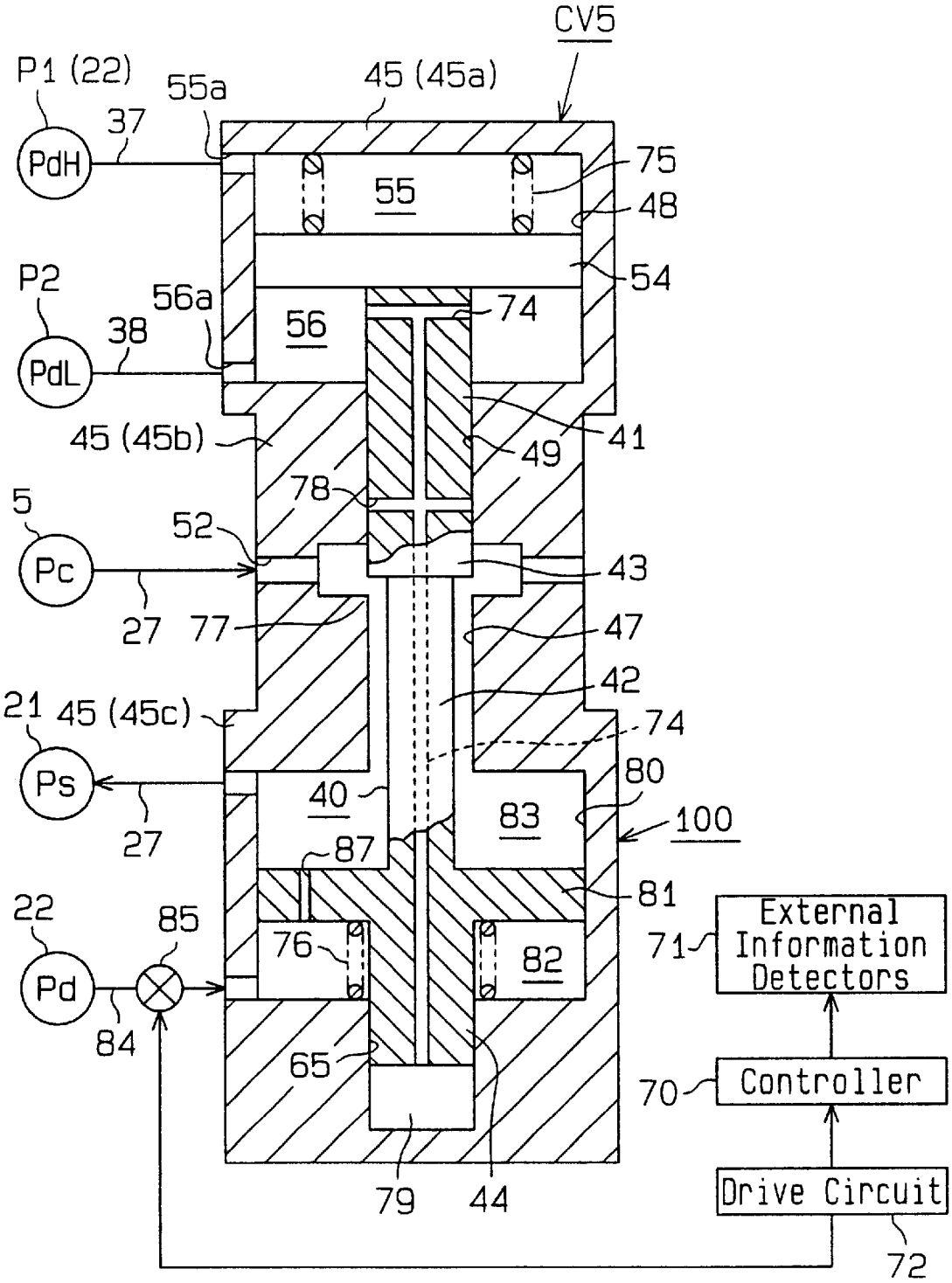
FIG. 12 is a cross-sectional view showing a displacement control valve of a sixth embodiment according to the present invention.

FIG. 12 shows a control valve CV5 of a sixth embodiment according to the present invention. The control valve CV5 is a modification of the control valve CV4 of FIGS. 10 and 11 and employs a pressure actuator having a spool as the solenoid 100. The control valve CV5 is a combination of the upper half of the control valve CV4 shown in FIGS. 10 and 11 and the lower half of the control valve CV3 shown in FIG. 9. The low pressure chamber 83 is connected to the suction chamber 21. The communication passage 47 functions also as a valve chamber and is connected to the low pressure chamber 83. The connecting portion 42 connects the valve body 43 to the spool 81. The cross-sectional area SC of the connecting portion 42 is smaller than the cross-sectional area SB of the communication passage 47. A portion of the connecting portion 42 is received in the communication passage 47 and the low pressure chamber 83. Accordingly, the crank chamber 5 is connected to the suction chamber 21 through the port 52, the communication passage 47, which is also a valve chamber, and the low pressure chamber 83, unless the rod 40 is moved downward from the state of FIG. 12 to close the passage 47 with the valve body 43. In other words, the port 52, the communication passage 47, and the low pressure chamber 83 form part of the bleeding passage 27 in the control valve CV5. The opening size of the bleeding passage 27 is adjusted in accordance with the size of the restriction passage formed by the valve body 43 and the step 77. Like the control valve CV4 of FIGS. 10 and 11, the control valve CV5 functions as an outlet control valve that varies the target pressure difference TPD.

When the pressure in the high pressure chamber 82 is equal to the pressure in the low pressure chamber 83 and the force of the return spring 75 is greater than the force of the retainer spring 76, the rod 40 is moved downward from the state of FIG. 12. The valve body 43 thus closes the communication passage 47. In this case, the pressure monitoring point P2 is connected to the crank chamber 5 through the internal passages 74, 78 of the rod 40. The control valve CV5 thus functions as an outlet control valve.

The control valve CV5 of FIG. 12 functions selectively as the inlet control valve and the outlet control valve. The control valve CV5 has the same advantages as the control valve CV4 of FIGS. 10 and 11.

In the control valve CV2 of FIG. 8 and the control valve CV3 of FIG. 9, the pressure PsH at the point P1 of FIG. 6 may be applied to the P1 pressure chamber 55, while the pressure PsL at the point P2 of FIG. 6 is applied to the pressure chamber 56.

In the control valve CV2 of FIG. 8, the control valve CV3 of FIG. 9, the control valve CV4 of FIGS. 10 and 11, and the control valve CV5 of FIG. 12, the internal passage 74 of the rod 40 is connected to the P1 pressure chamber 55. Accordingly, the pressure (PdH) at the pressure monitoring point P1, which is applied to the P1 pressure chamber 55, is introduced to the area around the proximal end of the rod 40.

The pressure monitoring point P1 may be located in a section of the suction pressure zone that includes the evaporator 33, the suction chamber 21,and the passage between the evaporator 33 and suction chamber 21, and the pressure monitoring point P2 may be located downstream of the pressure monitoring point P1 in the section.

The pressure monitoring point P1 may be located in a section of the discharge pressure zone that includes the condenser 31, the discharge chamber 22 and the passage between condenser 31 and the discharge chamber 22, and the pressure monitoring point P2 may be located in a section of the suction pressure zone that includes the evaporator 33, the suction chamber 21 and the passage between the evaporator 33 and the suction chamber 21.

The pressure monitoring point P1 may be located in a section of the discharge pressure zone that includes the condenser 31, the discharge chamber 22 and the passage between the condenser 31 and the discharge chamber, and the pressure monitoring point P2 may be located in the crank chamber 5. Alternatively, the pressure monitoring point P1 may be located in the crank chamber 5, and the pressure monitoring point P2 may be located in a section of the suction pressure zone that includes the evaporator 33, the suction chamber 21 and the passage between the evaporator 33 and the suction chamber 21. That is, the pressure monitoring points P1, P2 need not be located in a refrigerant passage that functions as a main passage of the refrigeration circuit and includes the evaporator 33, the suction chamber 21, the cylinder bores 12*a*, the discharge chambers 22 and the condenser 31. In other words, the pressure monitoring points P1, P2 need not be located in the high pressure zone or in the low pressure zone in the refrigeration circuit. For example, the pressure monitoring points P1, P2 may be located in the crank chamber 5. The crank chamber 5 is an intermediate pressure zone in a refrigerant passage for controlling the compressor displacement. The passage for controlling the displacement functions as an auxiliary circuit of the refrigeration circuit and includes the supply passage 28, the crank chamber 5 and bleeding passage.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A control valve used for a variable displacement compressor in a refrigerant circuit, wherein the compressor includes a crank chamber, a discharge pressure zone, a suction pressure zone, a supply passage for connecting the discharge pressure zone to the crank chamber, and a bleed passage for connecting the suction pressure zone to the crank chamber, the control valve comprising:

a valve housing;

a valve chamber defined in the valve housing;

a movable valve body located in the valve chamber to adjust opening size of the supply passage or the bleed passage;

a pressure sensing chamber defined in the valve housing;

a dividing member located in the sensing chamber to divide the pressure sensing chamber into a first pressure chamber and a second pressure chamber, wherein the pressure at a first pressure monitoring point located in the refrigerant circuit is applied to the first pressure chamber, and the pressure at a second pressure monitoring point located in the refrigerant circuit is applied to the second pressure chamber, wherein the dividing member moves in accordance with the pressure difference between the first pressure chamber and the second pressure chamber;

a rod for transmitting the movement of the dividing member to the valve body, wherein the rod has a proximal end and a distal end, wherein the distal end is coupled to the dividing member, wherein the pressure of the crank chamber is changed in accordance with the movement of the dividing member and the valve body to control the displacement of the compressor, wherein the vicinity of the proximal end of the rod is exposed to the pressure of the first pressure chamber or the second pressure chamber; and an urging mechanism for urging the rod axially with a force that represents a target pressure difference between the two pressure monitoring points.

2. The control valve according to claim 1, wherein the cross-sectional area of the distal end of the rod is substantially equal to an effective pressure receiving area of the proximal end of the rod to receive the pressure in the vicinity of the proximal end of the rod.

3. The control valve according to claim 2, wherein the distal end of the rod is located in the second pressure chamber, and the vicinity of the proximal end of the rod is exposed to the pressure of the first pressure chamber.

4. The control valve according to claim 2, wherein the distal end of the rod is located in the second pressure chamber, and the vicinity of the proximal end of the rod is exposed to the pressure of the second pressure chamber.

5. The control valve according to claim 1, wherein the rod has a connecting portion for connecting the distal end to the proximal end, wherein the cross-sectional area of the connecting portion is smaller than the cross-sectional area of the distal end.

6. The control valve according to claim 5, wherein the valve housing defines a guide hole, and a communication passage is formed in the guide hole the connecting portion occupies the guide hole, and wherein the valve chamber and the communication passage form part of the supply passage or the bleed passage.

7. The control valve according to claim 6, wherein the cross-sectional area of the proximal end of the rod is substantially equal to or greater than the cross-sectional area of the communication passage in the vicinity of the proximal end, wherein the cross-sectional area of the distal end of the rod is substantially equal to the cross-sectional area of the guide hole in the vicinity of the proximal end, whereby an effective pressure receiving area of the distal end that receives the pressure in the communication passage is substantially equal to an effective pressure receiving area of the proximal end that receives the pressure in the communication passage.

8. The control valve according to claim 1, wherein an inner passage is formed in the rod to apply the pressure of the first pressure chamber or of the second pressure chamber to the proximal end of the rod.

9. The control valve according to claim 1, wherein the urging mechanism includes an actuator for accommodating the proximal end of the rod, wherein the actuator varies a force applied to the rod in response to an external command.

10. The control valve according to claim 9, wherein the actuator is a solenoid for varying an electromagnetic force in accordance with the value of the electric current supplied to the solenoid.

11. The control valve according to claim 10, further comprising force means for applying force to the valve body, wherein, when no electric current is supplied to the solenoid, the force means moves the valve body and the rod to a position to increase the pressure of the crank chamber.

12. The control valve according to claim 1, wherein the dividing member is a movable wall. that moves axially in the valve housing.

13. The control valve according to claim 1, wherein the refrigeration circuit has a condenser, wherein the first and the second pressure monitoring points are located in a section of the refrigeration circuit that includes the condenser, the discharge pressure zone and the passage between the condenser and the discharge pressure zone.

14. A control valve used for a variable displacement compressor in a refrigerant circuit, wherein the compressor is a part of a refrigerant circuit, and wherein the compressor includes a crank chamber, a discharge pressure zone, a suction pressure zone, a supply passage for connecting the discharge pressure zone to the crank chamber, and a bleed passage for connecting the suction pressure zone to the crank chamber, the control valve comprising:

a valve housing;

a valve chamber defined in the valve housing;

a movable valve body located in the valve chamber to adjust opening size of the supply passage or the bleed passage;

a pressure sensing chamber defined in the valve housing;

a dividing member located in the sensing chamber to separate a first pressure chamber from a second pressure chamber, wherein the pressure at an upstream pressure monitoring point located in the refrigerant circuit is applied to the first pressure chamber, and the pressure at a downstream pressure monitoring point located in the refrigerant circuit is applied to the second pressure chamber, wherein the dividing member moves in accordance with the pressure difference between the first pressure chamber and the second pressure chamber;

a rod for transmitting the movement of the dividing member to the valve body, wherein the rod has a proximal end and a distal end, wherein the distal end is coupled to the dividing member, wherein the pressure of the crank chamber is changed in accordance with the movement of the dividing member and the valve body to control the displacement of the compressor, wherein the vicinity of the proximal end of the rod is exposed to the pressure of the first pressure chamber or the second pressure chamber; and an urging mechanism for urging the rod axially with a force that represents a target pressure difference between the two pressure monitoring points, wherein the urging mechanism urges the rod in a direction opposite to that the dividing member is urged by the pressure difference.

15. The control valve according to claim 14, wherein the cross-sectional area of the distal end of the rod is substantially equal to an effective pressure receiving area of the proximal end of the rod to receive the pressure in the vicinity of the proximal end of the rod.

16. The control valve according to claim 15, wherein the distal end of the rod is located in the second pressure chamber, and the vicinity of the proximal end of the rod is exposed to the pressure of the first pressure chamber.

17. The control valve according to claim 15, wherein the distal end of the rod is located in the second pressure chamber, and the vicinity of the proximal end of the rod is exposed to the pressure of the second pressure chamber.

18. The control valve according to claim 14, wherein the rod has a connecting portion for connecting the distal end to the proximal end, wherein the cross-sectional area of the connecting portion is smaller than the cross-sectional area of the distal end.

19. The control valve according to claim 18, wherein the valve housing defines a guide hole, and a communication passage is formed in the guide hole the connecting portion occupies the guide hole, and wherein the valve chamber and the communication passage form part of the supply passage or the bleed passage.

20. The control valve according to claim 19, wherein the cross-sectional area of the proximal end of the rod is substantially equal to or greater than the cross-sectional area of the communication passage in the vicinity of the proximal end, wherein the cross-sectional area of the distal end of the rod is substantially equal to the cross-sectional area of the guide hole in the vicinity of the proximal end, whereby an effective pressure receiving area of the distal end that receives the pressure in the communication passage is substantially equal to an effective pressure receiving area of the proximal end that receives the pressure in the communication passage.

21. The control valve according to claim 14, wherein an inner passage is formed in the rod to apply the pressure of the first pressure chamber or of the second pressure chamber to the proximal end of the rod.

22. The control valve according to claim 14, wherein the urging mechanism includes an actuator for accommodating the proximal end of the rod, wherein the actuator varies a force applied to the rod in response to an external command.

23. The control valve according to claim 22, wherein the actuator is a solenoid for varying an electromagnetic force in accordance with the value of the electric current supplied to the solenoid.

24. The control valve according to claim 23, further comprising force means for applying force to the valve body, wherein, when no electric current is supplied to the solenoid, the force means moves the valve body to a position to increase the pressure of the crank chamber.

25. The control valve according to claim 14, wherein the refrigeration circuit has a condenser, wherein the first and the second pressure monitoring points are located in a section of the refrigeration circuit that includes the condenser, the discharge pressure zone and the passage between the condenser and the discharge pressure zone.

* * * * *

UNITED STATES PATENT AND TRADEMARK OFFICE

CERTIFICATE OF CORRECTION

PATENT NO. : 6,371,734 B1
DATED : April 16, 2002
INVENTOR(S) : Masaki Ota et al.

It is certified that error appears in the above-identified patent and that said Letters Patent is hereby corrected as shown below:

Title page,
Item [56], References Cited, please add -- FOREIGN PATENT DOCUMENT(S)
11-107929 4/1999 (JP) --

Column 9,
Lines 29-30, please delete the equation and insert therefor
-- $\Sigma F2=F-f2-Pc(SV-SC)-Pd(SD-SB)+Pd\cdot SD=F-f2-Pc(SB-SC)+Pd\cdot SB$ --

Column 16,
Line 22, please delete "$\Sigma F1=f2+PdH-SA-PdL(SA-SB)-Pc(SB-SC)$" and insert therefore -- $\Sigma F1=f2+PdH\cdot SA-PdL(SA-SB)-Pc(SB-SC)$ --

Signed and Sealed this

Twenty-fourth Day of September, 2002

*Attest:*

*Attesting Officer*

JAMES E. ROGAN
*Director of the United States Patent and Trademark Office*